US009761229B2

(12) United States Patent
Xiang et al.

(10) Patent No.: US 9,761,229 B2
(45) **Date of Patent: *Sep. 12, 2017**

(54) SYSTEMS, METHODS, APPARATUS, AND COMPUTER-READABLE MEDIA FOR AUDIO OBJECT CLUSTERING

(71) Applicant: QUALCOMM Incorporated, San Diego, CA (US)

(72) Inventors: Pei Xiang, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 6 days.

This patent is subject to a terminal disclaimer.

(21) Appl. No.: 13/844,283

(22) Filed: Mar. 15, 2013

(65) Prior Publication Data

US 2014/0025386 A1 Jan. 23, 2014

Related U.S. Application Data

(60) Provisional application No. 61/673,869, filed on Jul. 20, 2012, provisional application No. 61/745,505, filed on Dec. 21, 2012.

(51) Int. Cl.
*G10L 19/00* (2013.01)
*G10L 19/008* (2013.01)

(52) U.S. Cl.
CPC ..... *G10L 19/00* (2013.01); *G10L 19/008* (2013.01)

(58) Field of Classification Search
CPC ..... G10L 19/008
USPC ..... 704/500
See application file for complete search history.

(56) References Cited

U.S. PATENT DOCUMENTS

| | | | | |
|---|---|---|---|---|
| 5,977,471 | A | 11/1999 | Rosenzweig | |
| 7,006,636 | B2 | 2/2006 | Baumgarte et al. | |
| 7,356,465 | B2 | 4/2008 | Tsingos et al. | |
| 7,447,317 | B2 | 11/2008 | Herre et al. | |
| 7,756,713 | B2 | 7/2010 | Chong et al. | |
| 7,979,282 | B2 | 7/2011 | Kim et al. | |
| 8,041,057 | B2 | 10/2011 | Xiang et al. | |
| 8,180,061 | B2 | 5/2012 | Hilpert et al. | |
| 8,234,122 | B2 | 7/2012 | Kim et al. | |
| 8,243,970 | B2 * | 8/2012 | Dent | H04R 5/02 381/1 |
| 8,315,396 | B2 | 11/2012 | Schreiner et al. | |
| 8,379,023 | B2 | 2/2013 | Aristarkhov | |
| 8,385,662 | B1 | 2/2013 | Yoon et al. | |

(Continued)

FOREIGN PATENT DOCUMENTS

| | | | |
|---|---|---|---|
| CN | 101461258 | A | 6/2009 |
| CN | 101479786 | A | 7/2009 |

(Continued)

OTHER PUBLICATIONS

Adrien_Daniel_PhD_thesis, "Spatial Auditory Blurring and Applications to Multichannel Audio Coding," Universit_e Pierre et Marie Curie—Paris, Sep. 14, 2011.*

(Continued)

*Primary Examiner* — Pierre-Louis Desir
*Assistant Examiner* — Forrest F Tzeng
(74) *Attorney, Agent, or Firm* — Shumaker & Sieffert, P.A.

(57) ABSTRACT

Systems, methods, and apparatus for grouping audio objects into clusters are described.

20 Claims, 23 Drawing Sheets

(56) References Cited

U.S. PATENT DOCUMENTS

| | | | | |
|---|---|---|---|---|
| 8,428,267 | B2 | 4/2013 | Oh et al. | |
| 8,515,106 | B2 | 8/2013 | Xiang et al. | |
| 8,594,817 | B2 | 11/2013 | Oh et al. | |
| 9,100,768 | B2 | 8/2015 | Batke et al. | |
| 2003/0031334 | A1* | 2/2003 | Layton | H04R 27/00 381/310 |
| 2003/0147539 | A1 | 8/2003 | Elko et al. | |
| 2003/0182001 | A1* | 9/2003 | Radenkovic | H04L 12/6418 700/94 |
| 2005/0114121 | A1* | 5/2005 | Tsingos | H04S 7/30 704/220 |
| 2006/0045275 | A1* | 3/2006 | Daniel | G10H 1/0091 381/17 |
| 2008/0140426 | A1 | 6/2008 | Kim et al. | |
| 2009/0125313 | A1 | 5/2009 | Hellmuth et al. | |
| 2009/0125314 | A1 | 5/2009 | Hellmuth et al. | |
| 2009/0210238 | A1 | 8/2009 | Kim et al. | |
| 2009/0210239 | A1 | 8/2009 | Yoon et al. | |
| 2009/0265164 | A1 | 10/2009 | Yoon et al. | |
| 2009/0287495 | A1* | 11/2009 | Breebaart | G10L 19/008 704/500 |
| 2010/0094631 | A1 | 4/2010 | Engdegard et al. | |
| 2010/0121647 | A1* | 5/2010 | Beack | G10L 19/008 704/500 |
| 2010/0161354 | A1 | 6/2010 | Lim et al. | |
| 2010/0191354 | A1 | 7/2010 | Oh et al. | |
| 2010/0228554 | A1 | 9/2010 | Beack et al. | |
| 2010/0324915 | A1* | 12/2010 | Seo | G10L 19/008 704/500 |
| 2011/0022402 | A1 | 1/2011 | Engdegard et al. | |
| 2011/0040395 | A1 | 2/2011 | Kraemer et al. | |
| 2011/0182432 | A1 | 7/2011 | Ishikawa et al. | |
| 2011/0249821 | A1* | 10/2011 | Jaillet | G10L 19/008 381/22 |
| 2011/0249822 | A1* | 10/2011 | Jaillet | G10L 19/008 381/22 |
| 2011/0264456 | A1 | 10/2011 | Koppens et al. | |
| 2011/0268281 | A1* | 11/2011 | Florencio | H04S 1/007 381/26 |
| 2012/0155653 | A1* | 6/2012 | Jax | G10L 19/008 381/22 |
| 2012/0230497 | A1 | 9/2012 | Dressler et al. | |
| 2012/0232910 | A1* | 9/2012 | Dressler | G10L 19/008 704/500 |
| 2012/0314878 | A1* | 12/2012 | Daniel | G10L 19/20 381/23 |
| 2013/0022206 | A1* | 1/2013 | Thiergart | G10L 19/008 381/17 |
| 2013/0132099 | A1 | 5/2013 | Oshikiri et al. | |
| 2013/0202129 | A1 | 8/2013 | Kraemer et al. | |
| 2014/0023196 | A1 | 1/2014 | Xiang et al. | |
| 2014/0023197 | A1 | 1/2014 | Xiang et al. | |
| 2015/0163615 | A1 | 6/2015 | Boehm et al. | |
| 2016/0104492 | A1 | 4/2016 | Dressler et al. | |

FOREIGN PATENT DOCUMENTS

| | | | |
|---|---|---|---|
| CN | 101553868 | B | 10/2009 |
| CN | 101675471 | A | 3/2010 |
| CN | 101878661 | A | 11/2010 |
| KR | 20070003543 | A | 1/2007 |
| WO | 2007143373 | A1 | 12/2007 |
| WO | 2009070699 | A1 | 6/2009 |
| WO | 2011160850 | A1 | 12/2011 |
| WO | 2012098425 | A1 | 7/2012 |
| WO | 2015059081 | A1 | 4/2015 |

OTHER PUBLICATIONS

Adrien_Daniel_PhD_thesis, "Spatial Auditory Blurring and Applications to Multichannel Audio Coding," Universite Pierre et Marie Curie—Paris, Sep. 14, 2011.*

Tsingos, et al. "Perceptual Audio Rendering of Complex Virtual Environments," ACM 2004.*

Advanced Television Systems Committee (ATSC): "ATSC Standard: Digital Audio Compression (AC-3, E-AC-3)," Doc.A/52:2012, Digital Audio Compression Standard, Mar. 23, 2012, 269 pp., Accessed online Jul. 15, 2012 < URL: www.atsc.org/cms/standards > [uploaded in parts].

Bates, "The Composition and Performance of Spatial Music", Ph.D. thesis, Univ. of Dublin, Aug. 2009, pp. 257, Accessed online Jul. 22, 2013 at http://endabates.net/Enda%20Bates%20-%20The%20Composition%20and%20Performance%20of%20Spatial%20Music.pdf [uploaded in parts].

Braasch, et al., "A Loudspeaker-Based Projection Technique for Spatial Music Applications Using Virtual Microphone Control", Computer Music Journal, 32:3, pp. 55-71, Fall 2008, Accessed online Jul. 6, 2012; available online Jul. 22, 2013 at http://www.rpi.edu/giving/print/Disney%20present/BraaschValentePeters2008CMJ_ViMiC.pdf.

Breebaart, et al., "Background, Concept, and Architecture for the Recent MPEG Surround Standard on Multichannel Audio Compression", pp. 21, J. Audio Eng. Soc., vol. 55, No. 5, May 2007, Accessed online Jul. 9, 2012; available online Jul. 22, 2013 at www.jeroenbreebaart.com/papers/jaes/jaes2007.pdf.

Breebaart, et al., "Binaural Rendering in MPEG Surround", EURASIP Journal on Advances in Signal Processing, vol. 2008, Article ID 732895, 14 pp.

Breebaart, et al., "MPEG Spatial Audio coding/MPEG surround: Overview and Current Status," Audio Engineering Society Convention Paper, Presented at the 119th Convention, Oct. 7-10, 2005, USA, 17 pp.

Breebaart, et al., "Parametric Coding of Stereo Audio", EURASIP Journal on Applied Signal Processing 2005:9, pp. 1305-1322.

European Broadcasting Union (EBU): "Specification of the Broadcast Wave Format (BWF): A format for audio data files in broadcasting, Supplement 1—MPEG audio", EBU-TECH 3285-E Supplement 1, Jul. 1997, Geneva, CH. pp. 14, Available online Jul. 22, 2013 at https://tech.ebu.ch/docs/tech/tech3285s1.pdf.

European Broadcasting Union (EBU): "Specification of the Broadcast Wave Format (BWF): A format for audio data files in broadcasting, Supplement 2—Capturing Report", EBU-TECH 3285 Supplement 2, Jul. 2001, Geneva, CH. pp. 14, Available online Jul. 22, 2013 at https://tech.ebu.ch/docs/tech/tech3285s2.pdf.

European Broadcasting Union (EBU): "Specification of the Broadcast Wave Format (BWF): A format for audio data files in broadcasting, Supplement 3—Peak Envelope Chunk", EBU-TECH 3285 Supplement 3, Jul. 2001, Geneva, CH. pp. 8, Available online Jul. 22, 2013 at https://tech.ebu.ch/docs/tech/tech3285s3.pdf.

European Broadcasting Union (EBU): "Specification of the Broadcast Wave Format (BWF): A format for audio data files in broadcasting, Supplement 4: <link> Chunk", EBU-TECH 3285 Supplement 4, Apr. 2003, Geneva, CH. pp. 4, Available online Jul. 22, 2013 at https://tech.ebu.ch/docs/tech/tech3285s4.pdf.

European Broadcasting Union (EBU): "Specification of the Broadcast Wave Format (BWF): A format for audio data files in broadcasting, Supplement 5: <axml> Chunk", EBU-TECH 3285 Supplement 5, Jul. 2003, Geneva, CH. pp. 3, Available online Jul. 22, 2013 at https://tech.ebu.ch/docs/tech/tech3285s5.pdf.

European Broadcasting Union (EBU): "Specification of the Broadcast Wave Format (BWF): A format for audio data files in broadcasting Version 2.0.", EBU-TECH 3285, May 2011, Geneva, CH. pp. 20, Available online Jul. 22, 2013 at https://tech.ebu.ch/docs/tech/tech3285.pdf.

European Broadcasting Union (EBU): "Specification of the Broadcast Wave Format (BWF): A format for audio data files, Supplement 6: Dolby Metadata, <dbmd> chunk", EBU-TECH 3285 suppl.6, Oct. 2009, Geneva, CH. pp. 46, Available online Jul. 22, 2013 at https://tech.ebu.ch/docs/tech/tech3285s6.pdf.

Fraunhofer Institute for Integrated Circuits: "White Paper: An Introduction to MP3 Surround", Mar. 2012, pp. 17, Accessed online Jul. 10, 2012; available online Jul. 22, 2013 at http://www.iis.fraunhofer.de/content/dam/iis/de/dokumente/amm/wp/introduction_mp3surround_03-2012.pdf.

(56) References Cited

OTHER PUBLICATIONS

Fraunhofer Institute for Integrated Circuits: "White Paper: The MPEG Standard on Parametric Object Based Audio Coding", Mar. 2012, pp. 4, Accessed online Jul. 5, 2012; available online Jul. 22, 2013 at http://www.iis.fraunhofer.de/content/dam/iis/en/dokumente/AMM/SAOC-wp_2012.pdf.
Herder, "Optimization of Sound Spatialization Resource Management through Clustering," Jan. 2000, 7 Pages.
Herre, "Efficient Representation of Sound Images: Recent Developments in Parametric Coding of Spatial Audio," pp. 40, Accessed online Jul. 9, 2012; accessed online Jul. 22, 2012 at www.img.lx.it.pt/pcs2007/presentations/JurgenHere_Sound_Images.pdf.
Herre, et al., "An Introduction to MP3 Surround", pp. 9, Accessed online Jul. 10, 2012; available online Jul. 22, 2013 at http://www.iis.fraunhofer.de/content/dam/iis/en/dokumente/AMM/introduction_to_mp3surround.pdf.
Herre, et al., "MPEG Surround—The ISO/MPEG Standard for Efficient and Compatible Multichannel Audio Coding", J. Audio Eng. Soc., vol. 56, No. 11, Nov. 2008, pp. 24, Accessed online Jul. 9, 2012; available online Jul. 22, 2013 at www.jeroenbreebaart.com/papers/jaes/jaes2008.pdf. [uploaded in parts].
Herre, et al., "The Reference Model Architecture for MPEG Spatial Audio Coding", 2005, pp. 13, Accessed online Jul. 11, 2012; available online Jul. 22, 2013 at http://www.iis.fraunhofer.de/content/dam/iis/de/dokumente/amm/ conference/AES6447_MPEG_Spatial_Audio_Reference_Model_Architecture.pdf.
Herre J., "Personal Audio: From Simple Sound Reproduction to Personalized Interactive Rendering", pp. 22, Accessed online Jul. 9, 2012; available online Jul. 22, 2013 at http://www.audiomostly.com/amc2007/programme/presentations/AudioMostlyHerre.pdf.
International Search Report and Written Opinion—PCT/US2013/051371—ISA/EPO—Sep. 27, 2013, 11 pp.
International Telecommunication Union (ITU): "Recommendation ITU-R BS.775-1: Multichannel Stereophonic Sound System With and Without Accompanying Picture", pp. 10, Jul. 1994.
Malham, "Spherical Harmonic Coding of Sound Objects—the Ambisonic 'O' Format," pp. 4, Accessed online Jul. 13, 2012; available online Jul. 22, 2013 at <URL: pcfarina.eng.unipr.it/Public/O-format/AES19-Malham.pdf>.
"Metadata Standards and Guidelines Relevant to Digital Audio", Prepared by the Preservation and Reformatting Section (PARS) Task Force on Audio Preservation Metadata in cooperation with the Music Library Association (MLA) Bibliographic Control Committee (BCC) Metadata Subcommittee, Feb. 17, 2010, pp. 5, Accessed online Jul. 22, 2013 at www.ala.org/alcts/files/resources/preserv/audio_metadata.pdf.
Moeck, et al., "Progressive Perceptual Audio Rendering of Complex Scenes," I3D '07 Proceedings of the 2007 symposium on Interactive 3D graphics and games, 2007, pp. 189-196.
Muscade Consortium: "D1.1.2: Reference architecture and representation format—Phase I", Ref. MUS.RP.00002.THO, Jun. 30, 2010, pp. 39, Accessed online Jul. 22, 2013 at www.muscade.eu/deliverables/D1.1.2.PDF.
Tsingos N., "Perceptually-Based Auralization," 19th International Congress on Acoustics Madrid, Sep. 2-7, 2007, 6 pp.
Peters N., et al., "Spatial sound rendering in MAX/MSP with VIMIC", pp. 4, Accessed online Jul. 6, 2012; available online Jul. 22, 2013 at nilspeters.info/papers/ICMC08-VIMIC_final.pdf.
Pro-MPEG Forum: "Pro-MPEG Code of Practice #2, May 2000: Operating Points for MPEG-2 Transport Streams on Wide Area Networks", pp. 10, Accessed online Dec. 5, 2012; available online Jul. 22, 2013 at www.pro-mpeg.org/documents/wancop2.pdf.
Silzle, "How to Find Future Audio Formats?" 2009, pp. 15, Accessed online Oct. 1, 2012; available online Jul. 22, 2013 at http://www.tonmeister.de/symposium/2009/np_pdf/A08.pdf.
Tsingos, et al., "Perceptual Audio Rendering of Complex Virtual Environments," ACM, 2004, pp. 249-258. (Applicant points out that, in accordance wtih MPEP 609.04(a), the 2004 year of publication is sufficiently earlier than the effective U.S. filing date and any foreign priority date of Jul. 20, 2012 so that the particular month of publication is not in issue).
"Wave PCM soundfile format", pp. 4, Jan. 2003, at https://ccrma.stanford.edu/courses/422/projects/WaveFormat/.
West, "Chapter 2: Spatial Hearing", pp. 10, Accessed online Jul. 25, 2012; accessed online Jul. 22, 2013 at http://www.music.miami.edu/programs/mue/Research/jwest/Chap_2/Chap_2_Spatial_Hearing.html.
International Preliminary Report on Patentability from International Application No. PCT/US2013/051371, dated Jan. 29, 2015, 8 pp.

* cited by examiner

SYSTEMS, METHODS, APPARATUS, AND COMPUTER-READABLE MEDIA FOR AUDIO OBJECT CLUSTERING

CLAIM OF PRIORITY UNDER 35 U.S.C. §119

The present application for patent claims priority to Provisional Application No. 61/673,869, entitled "SCALABLE DOWNMIX DESIGN FOR OBJECT-BASED SURROUND CODEC," filed Jul. 20, 2012, and assigned to the assignee hereof. The present application for patent also claims priority to Provisional Application No. 61/745,505, entitled "SCALABLE DOWNMIX DESIGN FOR OBJECT-BASED SURROUND CODEC," filed Dec. 21, 2012, and assigned to the assignee hereof.

BACKGROUND

Field

This disclosure relates to spatial audio coding.

Background

The evolution of surround sound has made available many output formats for entertainment nowadays. The range of surround-sound formats in the market includes the popular 5.1 home theatre system format, which has been the most successful in terms of making inroads into living rooms beyond stereo. This format includes the following six channels: front left (L), front right (R), center or front center (C), back left or surround left (Ls), back right or surround right (Rs), and low frequency effects (LFE)). Other examples of surround-sound formats include the growing 7.1 format and the futuristic 22.2 format developed by NHK (Nippon Hoso Kyokai or Japan Broadcasting Corporation) for use, for example, with the Ultra High Definition Television standard. It may be desirable for a surround sound format to encode audio in two dimensions and/or in three dimensions.

SUMMARY

A method of audio signal processing according to a general configuration includes, based on spatial information for each of N audio objects, grouping a plurality of audio objects that includes the N audio objects into L clusters, where L is less than N. This method also includes mixing the plurality of audio objects into L audio streams, and, based on the spatial information and said grouping, producing metadata that indicates spatial information for each of the L audio streams. Computer-readable storage media (e.g., non-transitory media) having tangible features that cause a machine reading the features to perform such a method are also disclosed.

An apparatus for audio signal processing according to a general configuration includes means for grouping, based on spatial information for each of N audio objects, a plurality of audio objects that includes the N audio objects into L clusters, where L is less than N. This apparatus also includes means for mixing the plurality of audio objects into L audio streams; and means for producing, based on the spatial information and said grouping, metadata that indicates spatial information for each of the L audio streams.

An apparatus for audio signal processing according to a further general configuration includes a clusterer configured to group, based on spatial information for each of N audio objects, a plurality of audio objects that includes the N audio objects into L clusters, where L is less than N. This apparatus also includes a downmixer configured to mix the plurality of audio objects into L audio streams; and a metadata downmixer configured to produce, based on the spatial information and said grouping, metadata that indicates spatial information for each of the L audio streams.

A method of audio signal processing according to another general configuration includes grouping a plurality of sets of coefficients into L clusters and, according to said grouping, mixing the plurality of sets of coefficients into L sets of coefficients. In this method, the plurality of sets of coefficients includes N sets of coefficients; L is less than N; each of the N sets of coefficients is associated with a corresponding direction in space; and the grouping is based on the associated directions. Computer-readable storage media (e.g., non-transitory media) having tangible features that cause a machine reading the features to perform such a method are also disclosed.

An apparatus for audio signal processing according to another general configuration includes means for grouping a plurality of sets of coefficients into L clusters; and means for mixing the plurality of sets of coefficients into L sets of coefficients, according to the grouping. In this apparatus, the plurality of sets of coefficients includes N sets of coefficients, L is less than N, wherein each of the N sets of coefficients is associated with a corresponding direction in space, and the grouping is based on the associated directions.

An apparatus for audio signal processing according to a further general configuration includes a clusterer configured to group a plurality of sets of coefficients into L clusters; and a downmixer configured to mix the plurality of sets of coefficients into L sets of coefficients, according to the grouping. In this apparatus, the plurality of sets of coefficients includes N sets of coefficients, L is less than N, each of the N sets of coefficients is associated with a corresponding direction in space, and the grouping is based on the associated directions.

BRIEF DESCRIPTION OF THE DRAWINGS

FIG. 8 shows a 5.1 transcoding matrix included in metadata during encoding, and FIG. 9 shows a transcoding matrix calculated at the decoder.

DETAILED DESCRIPTION

Figure 1A:
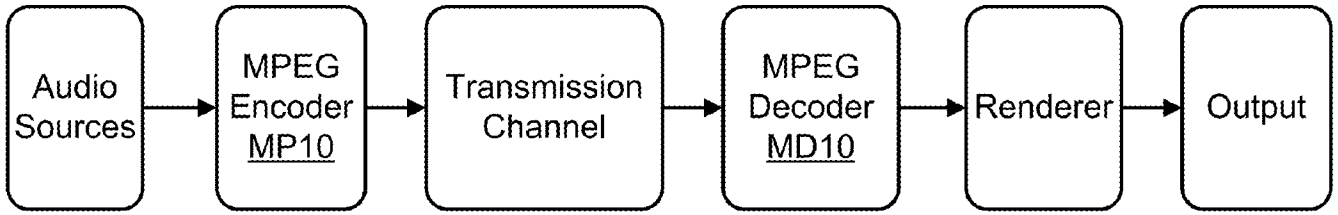
FIG. 1A shows a general structure for audio coding standardization, using an MPEG codec (coder/decoder).

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

Any incorporation by reference of a portion of a document shall also be understood to incorporate definitions of terms or variables that are referenced within the portion, where such definitions appear elsewhere in the document, as well as any figures referenced in the incorporated portion. Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, each of the terms "plurality" and "set" is used herein to indicate an integer quantity that is greater than one.

The types of surround setup through which a soundtrack is ultimately played may vary widely, depending on factors that may include budget, preference, venue limitation, etc. Even some of the standardized formats (5.1, 7.1, 10.2, 11.1, 22.2, etc.) allow setup variations in the standards. At the creator's side, a Hollywood studio will typically produce the soundtrack for a movie only once, and it is unlikely that efforts will be made to remix the soundtrack for each speaker setup. Accordingly, it may be desirable to encode the audio into bit streams and decode these streams according to the particular output conditions.

It may be desirable to provide an encoding of spatial audio information into a standardized bit stream and a subsequent decoding that is adaptable and agnostic to the speaker geometry and acoustic conditions at the location of the renderer. Such an approach may provide the goal of a uniform listening experience regardless of the particular setup that is ultimately used for reproduction. FIG. 1A illustrates a general structure for such standardization, using an MPEG codec. In this example, the input audio sources to encoder MP10 may include any one or more of the following, for example: channel-based sources (e.g., 1.0 (monophonic), 2.0 (stereophonic), 5.1, 7.1, 11.1, 22.2), object-based sources, and scene-based sources (e.g., high-order spherical harmonics, Ambisonics). Similarly, the audio output produced by decoder (and renderer) MP20 may include any one or more of the following, for example: feeds for monophonic, stereophonic, 5.1, 7.1, and/or 22.2 loudspeaker arrays; feeds for irregularly distributed loudspeaker arrays; feeds for headphones; interactive audio.

It may be desirable to follow a 'create-once, use-many' philosophy in which audio material is created once (e.g., by a content creator) and encoded into formats which can subsequently decoded and rendered to different outputs and loudspeaker setups. A content creator such as a Hollywood studio, for example, would typically like to produce the soundtrack for a movie once and not expend the effort to remix it for each possible loudspeaker configuration.

One approach that may be used with such a philosophy is object-based audio. An audio object encapsulates individual pulse-code-modulation (PCM) audio streams, along with their three-dimensional (3D) positional coordinates and other spatial information (e.g., object coherence) encoded as metadata. The PCM streams are typically encoded using, e.g., a transform-based scheme (for example, MPEG Layer-3 (MP3), AAC, MDCT-based coding). The metadata may also be encoded for transmission. At the decoding and rendering end, the metadata is combined with the PCM data to recreate the 3D sound field. Another approach is channel-based audio, which involves the loudspeaker feeds for each of the loudspeakers, which are meant to be positioned in a predetermined location (such as for 5.1 surround sound/home theatre and the 22.2 format).

One problem that may arise with an object-based approach is the excessive bit rate or bandwidth that may be involved when many such audio objects are used to describe the sound field. A smart and adaptable downmix scheme for object-based 3D audio coding is proposed. Such a scheme may be used to make the codec scalable while still preserving audio object independence and render flexibility within the limits of, for example, bit rate, computational complexity, and/or copyright constraints.

One of the main approaches of spatial audio coding is object-based coding. In the content creation stage, individual spatial audio objects (e.g., PCM data) and their corresponding location information are encoded separately. Two examples that use the object-based philosophy are provided here for reference.

Figure 1B:
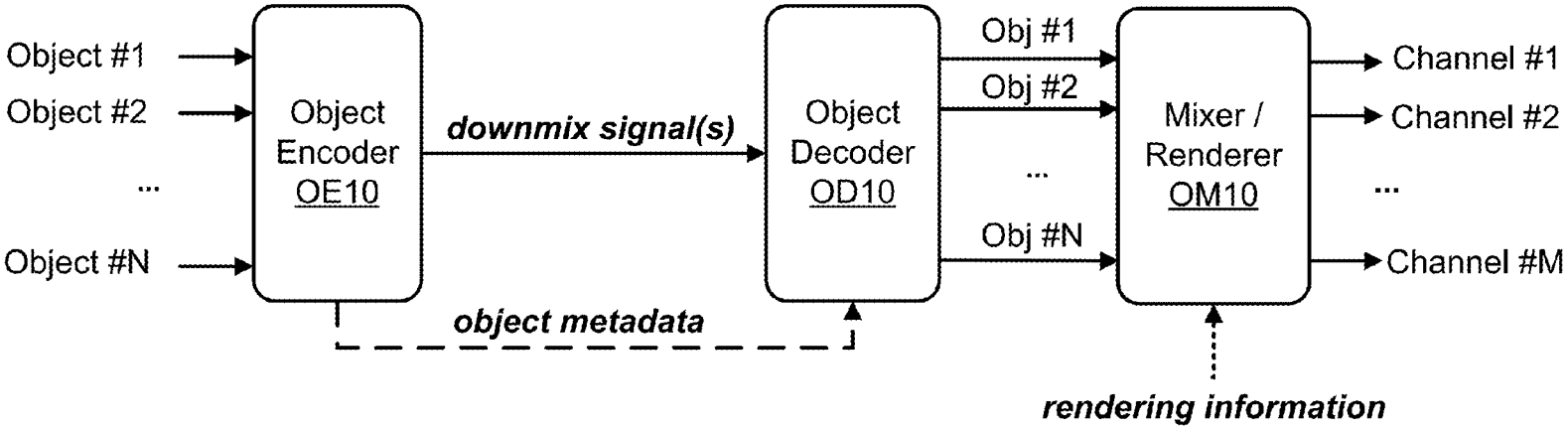
FIGS. 1B and 2A show conceptual overviews of Spatial Audio Object Coding (SAOC).
Figure 2A:
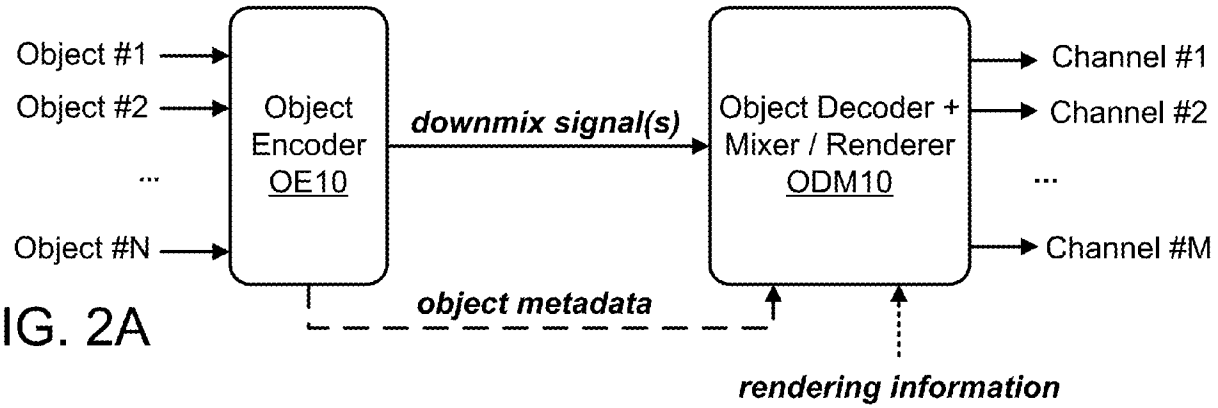

The first example is Spatial Audio Object Coding (SAOC), in which all objects are downmixed (e.g., by an encoder OE10 as shown in FIG. 1B) to a mono or stereo PCM stream for transmission. Such a scheme, which is based on binaural cue coding (BCC), also includes a metadata bitstream, which may include values of parameters such as interaural level difference (ILD), interaural time difference (ITD), and inter-channel coherence (ICC, relating to the diffusivity or perceived size of the source) and may be encoded into as little as one-tenth of an audio channel. FIG. 1B shows a conceptual diagram of an SAOC implementation in which the decoder OD 10 and mixer OM10 are separate modules. FIG. 2A shows a conceptual diagram of an SAOC implementation that includes an integrated decoder and mixer ODM10. As shown in FIGS. 1B and 2A, the mixing and/or rendering operations may be performed based on rendering information from the local environment, such as the number of loudspeakers, the positions and/or responses of the loudspeakers, the room response, etc.

In implementation, SAOC is tightly coupled with MPEG Surround (MPS, ISO/IEC 14496-3, also called High-Efficiency Advanced Audio Coding or HeAAC), in which the six channels of a 5.1 format signal are downmixed into a mono or stereo PCM stream, with corresponding side-information (such as ILD, ITD, ICC) that allows the synthesis of the rest of the channels at the renderer. While such a scheme may have a quite low bit rate during transmission, the flexibility of spatial rendering is typically limited for SAOC. Unless the intended render locations of the audio objects are very close to the original locations, it can be expected that audio quality will be compromised. Also, when the number of audio objects increases, doing individual processing on each of them with the help of metadata may become difficult.

Figure 2B:
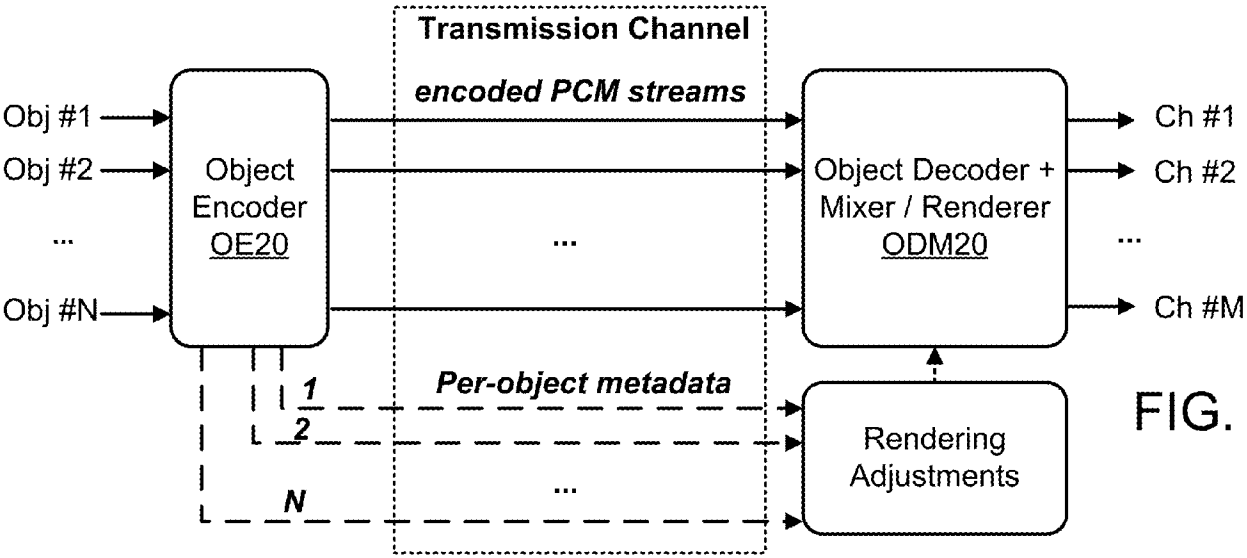
FIG. 2B shows a conceptual overview of one object-based coding approach.

FIG. 2B shows a conceptual overview of the second example, an object-based coding scheme in which each sound source PCM stream is individually encoded and transmitted by an encoder OE20, along with their respective metadata (e.g., spatial data). At the renderer end, the PCM objects and the associated metadata are used (e.g., by decoder/mixer/renderer ODM20) to calculate the speaker feeds based on the positions of the speakers, with the metadata providing adjustment information to the mixing and/or rendering operations. For example, a panning method (e.g., vector base amplitude panning or VBAP) may be used to individually spatialize the PCM streams back to a surround-sound mix. At the renderer end, the mixer usually has the appearance of a multi-track editor, with PCM tracks laying out and spatial metadata as editable control signals. It will be understood that the object decoder and mixer/renderer shown in this figure (and elsewhere in this document) may be implemented as an integrated structure or as separate decoder and mixer/renderer structures, and that the mixer/renderer itself may be implemented as an integrated structure (e.g., performing an integrated mixing/rendering operation) or as a separate mixer and renderer performing independent respective operations.

Although an approach as shown in FIG. 2B allows maximum flexibility, it also has potential drawbacks. Obtaining individual PCM audio objects from the content creator may be difficult, and the scheme may provide an insufficient level of protection for copyrighted material, as the decoder end can easily obtain the original audio objects (which may include, for example, gunshots and other sound effects). Also the soundtrack of a modern movie can easily involve hundreds of overlapping sound events, such that encoding each PCM object individually may fail to fit all the data into limited-bandwidth transmission channels even with a moderate number of audio objects. Such a scheme does not address this bandwidth challenge, and therefore this approach may be prohibitive in terms of bandwidth usage.

For object-based audio, it may be desirable to address the excessive bit-rate or bandwidth that would be involved when there are many audio objects to describe the sound field. Similarly, the coding of channel-based audio may also become an issue when there is a bandwidth constraint.

Scene-based audio is typically encoded using an Ambisonics format, such as B-Format. The channels of a B-Format signal correspond to spherical harmonic basis functions of the sound field, rather than to loudspeaker feeds. A first-order B-Format signal has up to four channels (an omnidirectional channel W and three directional channels X, Y, Z); a second-order B-Format signal has up to nine channels (the four first-order channels and five additional channels R, S, T, U, V); and a third-order B-Format signal has up to sixteen channels (the nine second-order channels and seven additional channels K, L, M, N, O, P, Q).

Figure 3A:
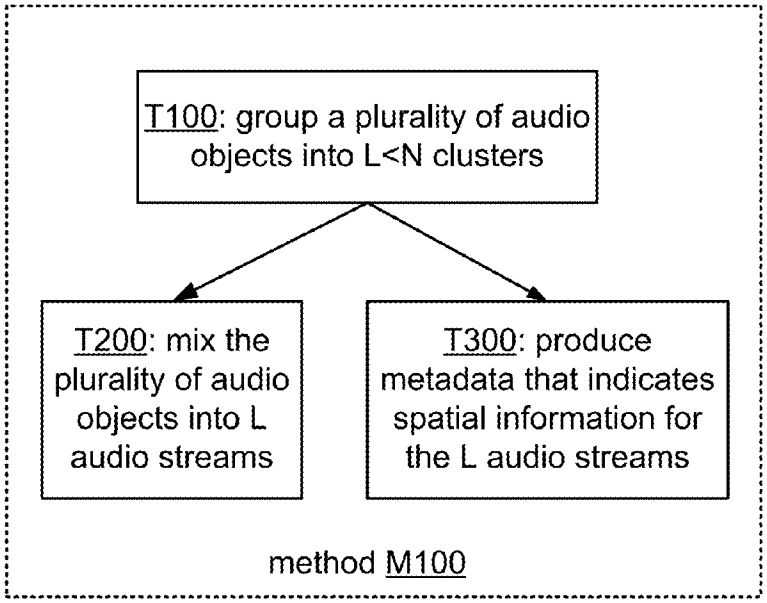
FIG. 3A shows a flowchart for a method M100 of audio signal processing according to a general configuration.

Having in mind the problems of the above two approaches, a scalable channel reduction method that uses a cluster-based downmix is proposed. FIG. 3A shows a flowchart for a method M100 of audio signal processing according to a general configuration that includes tasks T100, T200, and T300. Based on spatial information for each of N audio objects, task T100 groups a plurality of audio objects that includes the N audio objects into L clusters, where L is less than N. Task T200 mixes the plurality of audio objects into L audio streams. Based on the spatial information, task T300 produces metadata that indicates spatial information for each of the L audio streams. It may be desirable to implement MPEG encoder MP10 as shown in FIG. 1A to perform an implementation of method M100, M300, or M500 as described herein (e.g., to produce a bitstream for streaming, storage, broadcast, multicast, and/or media mastering (for example, mastering of CD, DVD, and/or Blu-Ray™ Disc)).

Each of the N audio objects may be provided as a PCM stream. Spatial information for each of the N audio objects is also provided. Such spatial information may include a location of each object in three-dimensional coordinates (cartesian or spherical polar (e.g., distance-azimuth-elevation)). Such information may also include an indication of the diffusivity of the object (e.g., how point-like or, alternatively, spread-out the source is perceived to be), such as a spatial coherence function. The spatial information may be obtained from a recorded scene using a multi-microphone method of source direction estimation and scene decomposition (e.g., as described in U.S. Publ. Pat. Appl. No. 2012/0128160 (Kim et al.), publ. May 24, 2012). In this case, such a method (e.g., as described herein with reference to FIG. 13 et seq.) may be performed within the same device (e.g., a smartphone, tablet computer, or other portable audio sensing device) that performs method M100.

In one example, the set of N audio objects may include PCM streams recorded by microphones at arbitrary relative locations, together with information indicating the spatial position of each microphone. In another example, the set of N audio objects may also include a set of channels corresponding to a known format (e.g., a 5.1, 7.1, or 22.2 surround-sound format), such that location information for each channel (e.g., the corresponding loudspeaker location) is implicit. In this context, channel-based signals (or loudspeaker feeds) are just PCM feeds in which the locations of the objects are the pre-determined positions of the loudspeakers. Thus channel-based audio can be treated as just a subset of object-based audio in which the number of objects is fixed to the number of channels.

Task T100 may be implemented to group the audio objects by performing a cluster analysis, at each time segment, on the audio objects presented. It is possible that task T100 may be implemented to group more than the N audio objects into the L clusters. For example, the plurality of audio objects may include one or more objects for which no metadata is available (e.g., a non-directional or completely diffuse sound) or for which the metadata is generated at or is otherwise provided to the decoder. Additionally or alternatively, the set of audio objects to be encoded for transmission or storage may include, in addition to the plurality of audio objects, one or more objects that are to remain separate from the clusters in the output stream. In recording a sports event, for example, it may be desirable to transmit a commentator's dialogue separably from other sounds of the event, as an end user may wish to control the volume of the dialogue relative to the other sounds (e.g., to enhance, attenuate, or block such dialogue).

Methods of cluster analysis may be used in applications such as data mining. Algorithms for cluster analysis are not specific and can take different approaches and forms. A typical example of a clustering method that may be performed by task T100 is k-means clustering, which is a centroid-based clustering approach. Based on a specified number of clusters k, individual objects will be assigned to the nearest centroid and grouped together.

Figure 4:
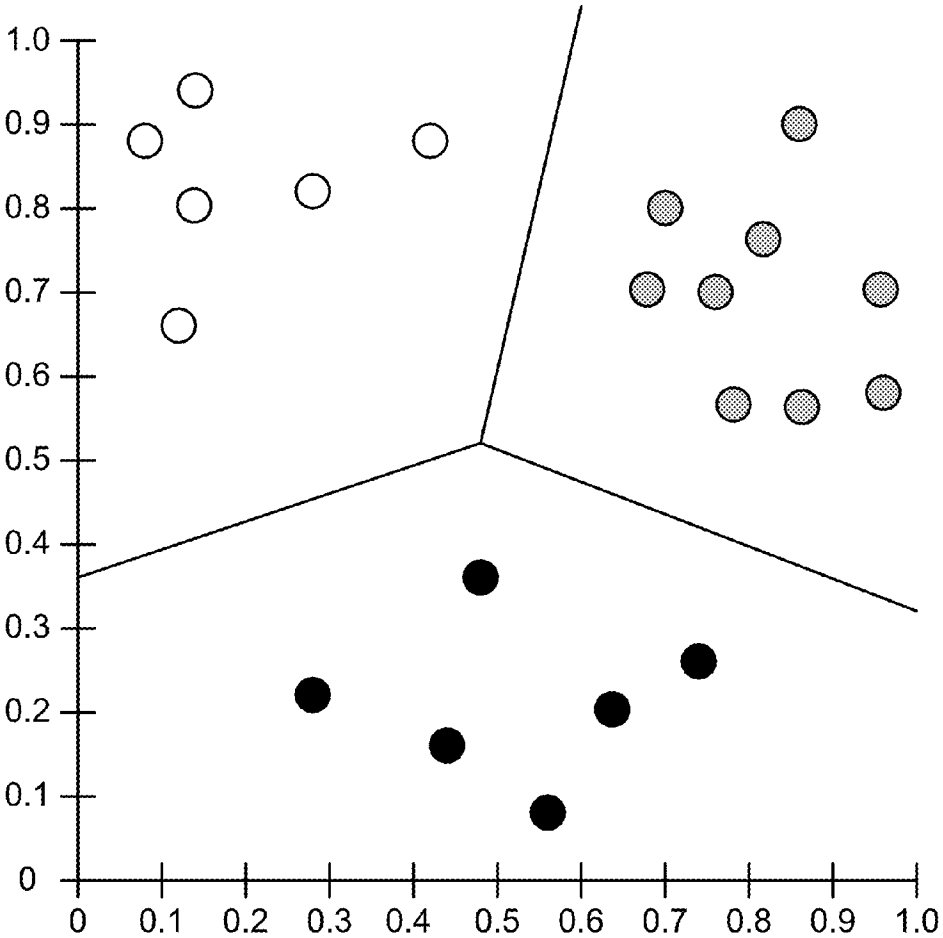
FIG. 4 shows an example of k-means clustering with three cluster centers.

FIG. 4 shows an example visualization of a two-dimensional k-means clustering, although it will be understood that clustering in three dimensions is also contemplated and hereby disclosed. In the particular example of FIG. 4, the value of k is three, although any other positive integer value (e.g., larger than three) may also be used. Spatial audio objects may be classified according to their spatial location (e.g., as indicated by metadata) and clusters are identified, then each centroid corresponds to a downmixed PCM stream and a new vector indicating its spatial location.

In addition or in the alternative to a centroid-based clustering approach (e.g., k-means), task T100 may be implemented to use one or more other clustering approaches to cluster a large number of audio sources. Examples of such other clustering approaches include distribution-based clustering (e.g., Gaussian), density-based clustering (e.g., density-based spatial clustering of applications with noise (DBSCAN), EnDBSCAN, Density-Link-Clustering, or OPTICS), and connectivity based or hierarchical clustering (e.g., unweighted pair group method with arithmetic mean, also known as UPGMA or average linkage clustering).

Additional rules may be imposed on the cluster size according to the object locations and/or the cluster centroid locations. For example, it may be desirable to take advantage of the directional dependence of the human auditory system's ability to localize sound sources. The capability of the human auditory system to localize sound sources is typically much better for arcs on the horizontal plane than for arcs that are elevated from this plane. The spatial hearing resolution of a listener is also typically finer in the frontal area as compared to the rear side. In the horizontal plane that includes the interaural axis, this resolution (also called "localization blur") is typically between 0.9 and four degrees (e.g., +/−three degrees) in the front, +/−ten degrees at the sides, and +/−six degrees in the rear, such that it may be desirable to assign pairs of objects within these ranges to the same cluster. Localization blur may be expected to increase with elevation above or below this plane. For spatial locations in which the localization blur is large, we can group more audio objects into a cluster to produce a smaller total number of clusters, since the listener's auditory system will typically be unable to differentiate these objects well anyway.

Figure 5:
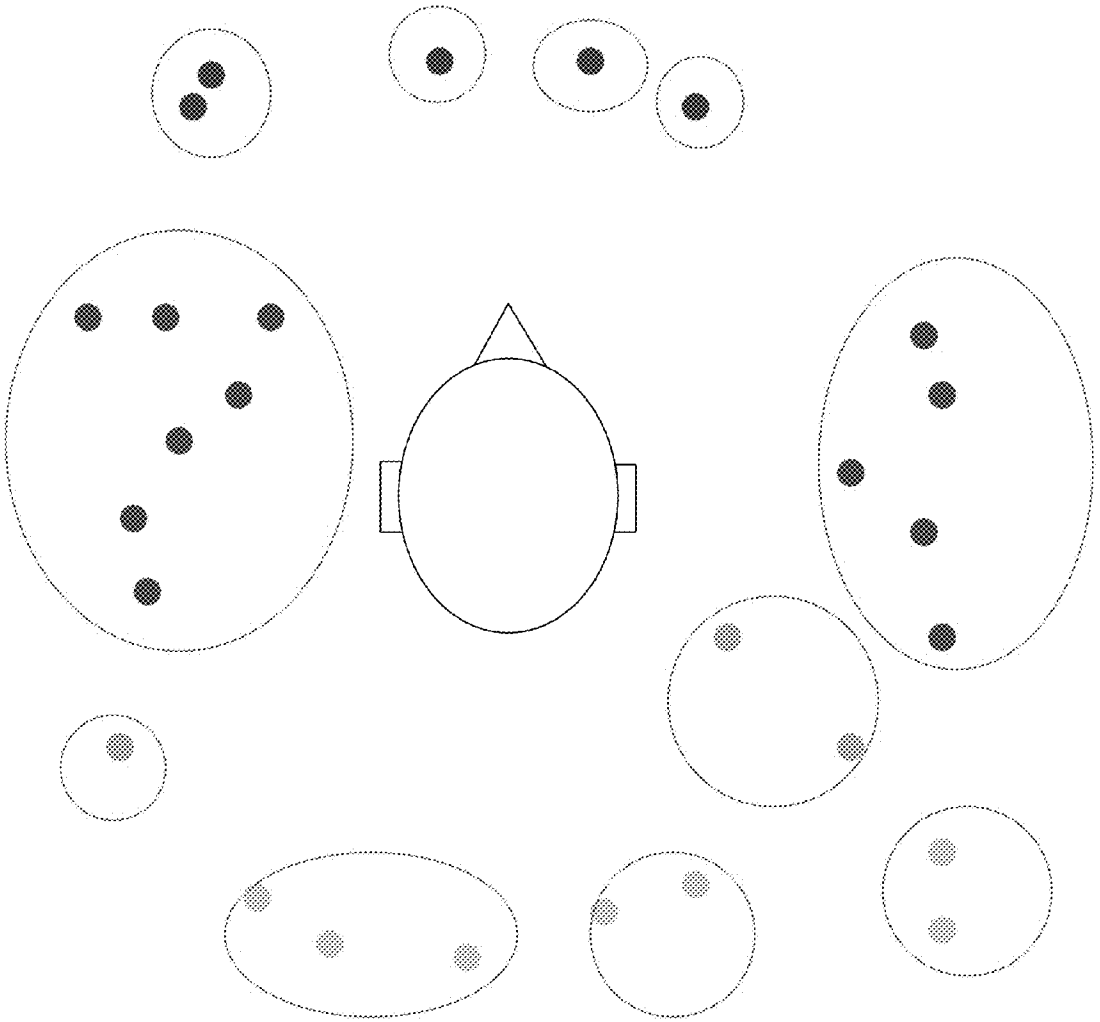
FIG. 5 shows an example of different cluster sizes with cluster centroid location.

FIG. 5 shows one example of direction-dependent clustering. In the example, a large cluster number is presented. The frontal objects are finely separated with clusters, while near the "cone of confusion" at either side of the listener's head, lots of objects are grouped together and rendered as one cluster. In this example, the sizes of the clusters behind the listener's head are also larger than those in front of the listener.

It may be desirable to specify values for one or more control parameters of the cluster analysis (e.g., number of clusters). For example, a maximum number of clusters may be specified according to the transmission channel capacity and/or intended bit rate. Additionally or alternatively, a maximum number of clusters may be based on the number of objects and/or perceptual aspects. Additionally or alternatively, a minimum number of clusters (or, e.g., a minimum value of the ratio N/L) may be specified to ensure at least a minimum degree of mixing (e.g., for protection of proprietary audio objects). Optionally a specified cluster centroid information can also be specified.

It may be desirable to update the cluster analysis over time, and the samples passed from one analysis to the next. The interval between such analyses may be called a downmix frame. Such an update may occur periodically (e.g., one, two, or five times per second, or every two, five, or ten seconds) and/or in response to detection of an event (e.g., a change in the location of an object, a change in the average energy of an object, and/or a movement of the listener's head). It may be desirable to overlap such analysis frames (e.g., according to analysis or processing requirements). From one analysis to the next, the number and/or composition of the clusters may change, and objects may come and go between each cluster. When an encoding requirement changes (e.g., a bit-rate change in a variable-bit-rate coding scheme, a changing number of source objects, etc), the total number of clusters, the way in which objects are grouped into the clusters, and/or the locations of each of one or more clusters may also change over time.

It may be desirable for the cluster analysis to prioritize objects according to diffusivity (e.g., apparent spatial width). For example, the sound field produced by a concentrated point source, such as a bumblebee, typically requires more bits to model sufficiently than a spatially wide source, such as a waterfall, that typically does not require precise positioning. In one such example, task T100 is implemented to cluster only objects having a high measure of spatial concentration (or a low measure of diffusivity), which may be determined by applying a threshold value to such a measure. In this example, the remaining diffuse sources may be encoded together, or individually, at a lower bit rate than the clusters. For example, a small reservoir of bits may be reserved in the allotted bitstream to carry the encoded diffuse sources.

For each audio object, the downmix gain contribution to its assigned cluster centroid is also likely to change over time. For example, in FIG. 5, the objects in each of the two lateral clusters can also contribute to the frontal clusters, although with very low gains. Over time, it may be desirable to check neighboring frames for changes in each object's location and/or changes in the distribution of objects among and/or within the clusters. During the downmix of PCM streams, gain changes for each object within a frame may be applied smoothly, to avoid audio artifacts that may be caused by a sudden gain change from one frame to the next. Any one or more of various known temporal smoothing methods may be applied, such as a linear gain change (e.g., linear gain interpolation between frames) and/or a smooth gain change according to the spatial movement of an object from one frame to the next.

Task T200 downmixes the original N audio objects to L clusters. For example, task T200 may be implemented to perform a downmix, according to the cluster analysis results, to reduce the PCM streams from the plurality of audio objects down to L mixed PCM streams (e.g., one mixed PCM stream per cluster). This PCM downmix may be conveniently performed by a downmix matrix. The matrix coefficients and dimensions are determined by, e.g., the analysis in task T100, and additional arrangements of method M100 may be implemented using the same matrix with different coefficients. The content creator can also specify a minimal downmix level (e.g., a minimum required level of mixing), so that the original sound sources can be obscured to provide protection from renderer-side infringement or other abuse of use. Without loss of generality, the downmix operation can be expressed as $$C_{(L\times 1)}=A_{(L\times N)}S_{(N\times 1)},$$

where S is the original audio vector, C is the resulting cluster audio vector, and A is the downmix matrix.

Task T300 downmixes metadata for the N audio objects into metadata for the L audio clusters according to the grouping indicated by task T100. Such metadata may include, for each cluster, an indication of the angle and distance of the cluster centroid in three-dimensional coordinates (e.g., cartesian or spherical polar (e.g., distance-azimuth-elevation)). The location of a cluster centroid may be calculated as an average of the locations of the corresponding objects (e.g., a weighted average, such that the location of each object is weighted by its gain relative to the other objects in the cluster). Such metadata may also include, for each of one or more (possibly all) of the clusters, an indication of the diffusivity of the cluster. Such an indication may be based on diffusivities of objects in the cluster (e.g., a weighted average, such that the diffusivity of each object is weighted by its gain relative to the other objects in the cluster) and/or a spatial distribution of the objects within the cluster (e.g., a weighted average of the distance of each object from the centroid of the cluster, such that the distance of each object from the centroid is weighted by its relative gain).

An instance of method M100 may be performed for each time frame. With proper spatial and temporal smoothing (e.g., amplitude fade-ins and fade-outs), the changes in different clustering distribution and numbers from one frame to another can be inaudible.

The L PCM streams may be outputted in a file format. In one example, each stream is produced as a WAV file compatible with the WAVE file format (e.g., as described in "Multiple Channel Audio Data and WAVE Files," updated Mar. 7, 2007, Microsoft Corp., Redmond, Wash., available online at msdn.microsoft-dot-com/en-us/windows/hardware/gg463006-dot-aspx). It may be desirable to use a codec to encode the L PCM streams before transmission over a transmission channel (or before storage to a storage medium, such as a magnetic or optical disk) and to decode the L PCM streams upon reception (or retrieval from storage). Examples of audio codecs, one or more of which may be used in such an implementation, include MPEG Layer-3 (MP3), Advanced Audio Codec (AAC), codecs based on a transform (e.g., a modified discrete cosine transform or MDCT), waveform codecs (e.g., sinusoidal codecs), and parametric codecs (e.g., code-excited linear prediction or CELP). The term "encode" may be used herein to refer to method M100 or to a transmission-side of such a codec; the particular intended meaning will be understood from the context. For a case in which the number of streams L may vary over time, and depending on the structure of the particular codec, it may be more efficient for a codec to provide a fixed number Lmax of streams, where Lmax is a maximum limit of L, and to maintain any temporarily unused streams as idle, than to establish and delete streams as the value of L changes over time.

Typically the metadata produced by task T300 will also be encoded (e.g., compressed) for transmission or storage (using, e.g., any suitable entropy coding or quantization technique). As compared to a complex algorithm such as SAOC, which includes frequency analysis and feature extraction procedures, a simple downmix implementation of method M100 may be expected to be computationally light.

Figure 6A:
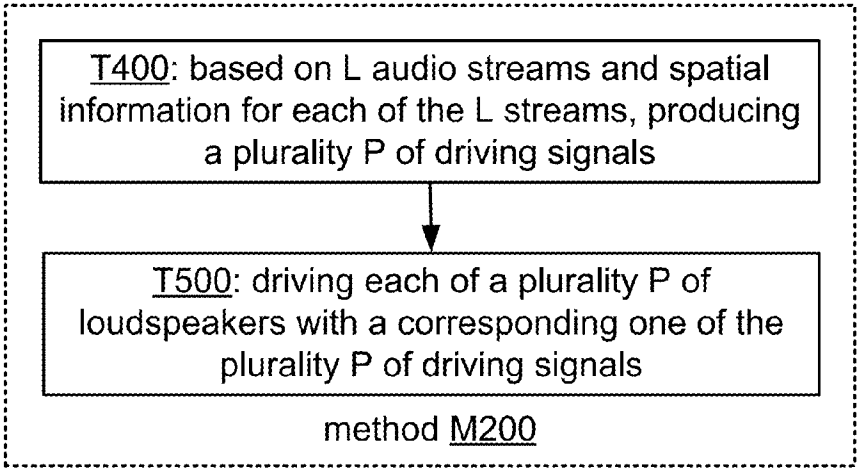
FIG. 6A shows a flowchart for a method M200 of audio signal processing according to a general configuration.

FIG. 6A shows a flowchart of a method M200 of audio signal processing according to a general configuration that includes tasks T400 and T500. Based on L audio streams and spatial information for each of the L streams, task T400 produces a plurality P of driving signals. Task T500 drives each of a plurality P of loudspeakers with a corresponding one of the plurality P of driving signals.

At the decoder side, spatial rendering is performed per cluster instead of per object. A wide range of designs are available for the rendering. For example, flexible spatialization techniques (e.g., VBAP or panning) and speaker setup formats can be used. Task T400 may be implemented to perform a panning or other sound field rendering technique (e.g., VBAP). The resulting spatial sensation will resemble the original at high cluster counts; with low cluster counts, data is reduced, but a certain flexibility on object location rendering is still available. Since the clusters still preserve the original location of audio objects, the spatial sensation will be very close to the original sound field if a sufficient number of clusters can be accommodated.

Figure 7:
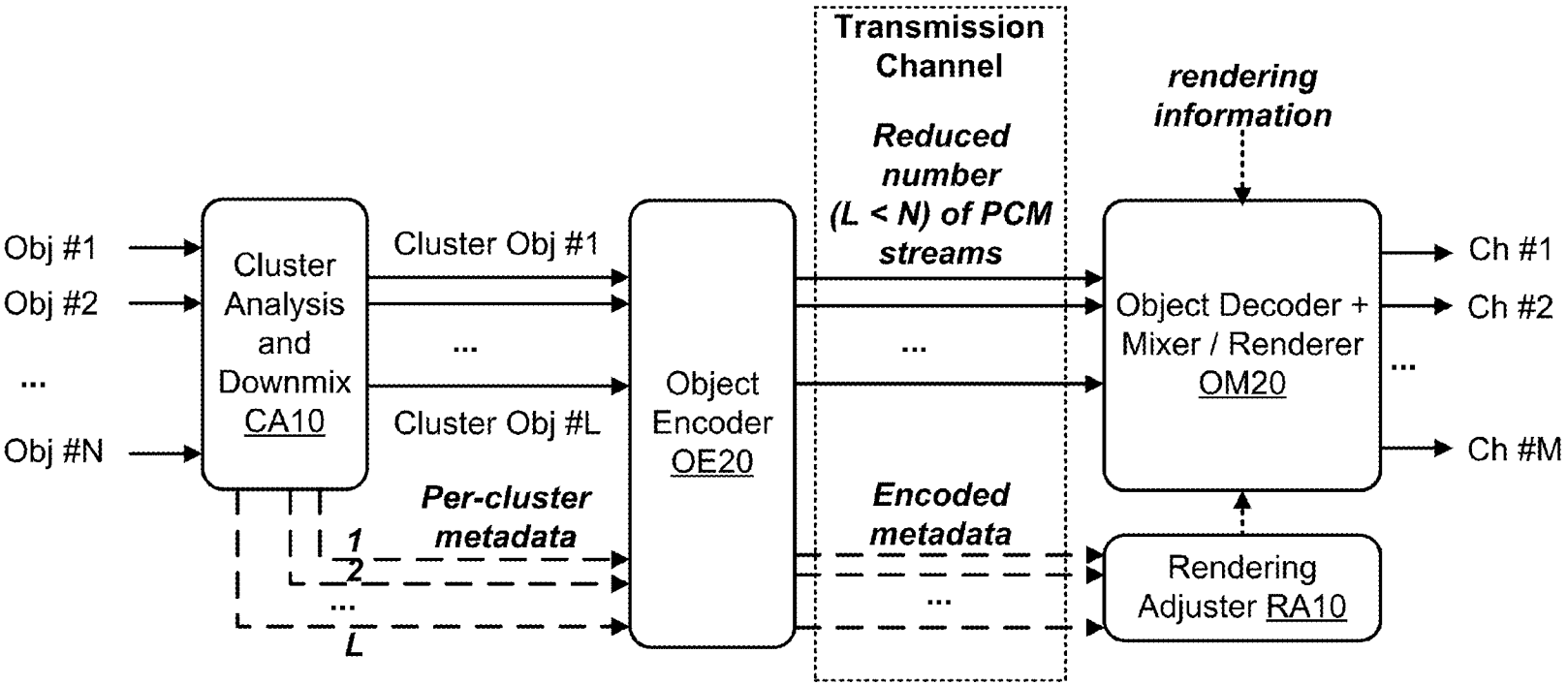
FIG. 7 shows a conceptual overview of a coding scheme as described herein with cluster analysis and downmix design.

FIG. 7 shows a conceptual diagram of a system that includes a cluster analyzer and downmixer CA10 that may be implemented to perform method M100, and an object decoder and mixer/renderer OM20 and rendering adjuster RA10 that may be implemented to perform method M200. This example also includes a codec as described herein that comprises an object encoder OE20 configured to encode the L mixed streams and an object decoder OM20 configured to decode the L mixed streams.

Such an approach may be implemented to provide a very flexible system to code spatial audio. At low bit rates, a small number of clusters may compromise audio quality, but the result is usually better than a straight downmix to only mono or stereo. At higher bit rates, as the number of clusters increases, spatial audio quality and render flexibility may be expected to increase. Such an approach may also be implemented to be scalable to constraints during operation, such as bit rate constraints. Such an approach may also be implemented to be scalable to constraints at implementation, such as encoder/decoder/CPU complexity constraints. Such an approach may also be implemented to be scalable to copyright protection constraints. For example, a content creator may require a certain minimum downmix level (e.g., a minimum number of objects per cluster) to prevent availability of the original source materials.

It is also contemplated that methods M100 and M200 may be implemented to process the N audio objects on a frequency subband basis. Examples of scales that may be used to define the various subbands include, without limitation, a critical band scale and an Equivalent Rectangular Bandwidth (ERB) scale. In one example, a hybrid Quadrature Mirror Filter (QMF) scheme is used.

Figure 8:
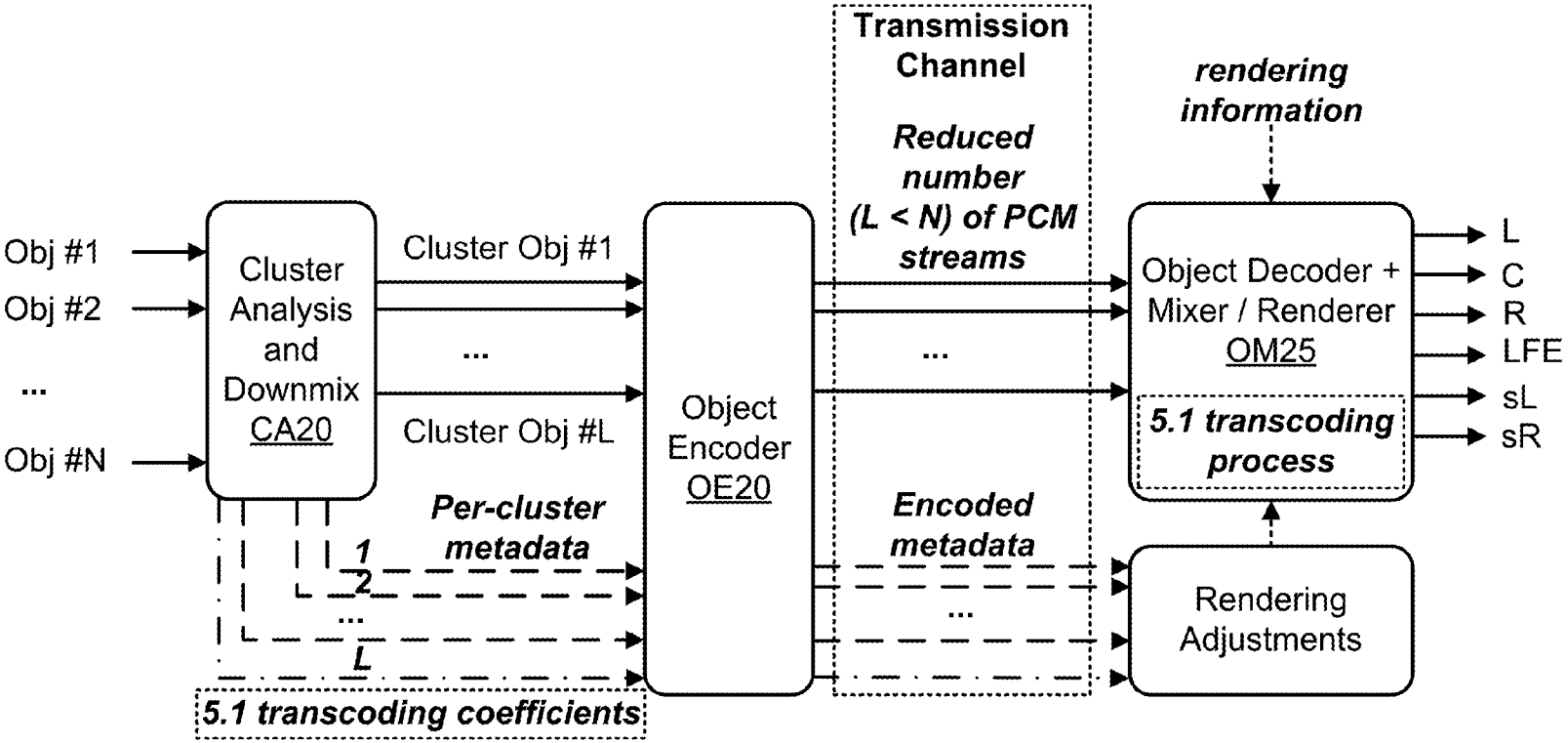
FIGS. 8 and 9 show transcoding for backward compatibility.
Figure 9:
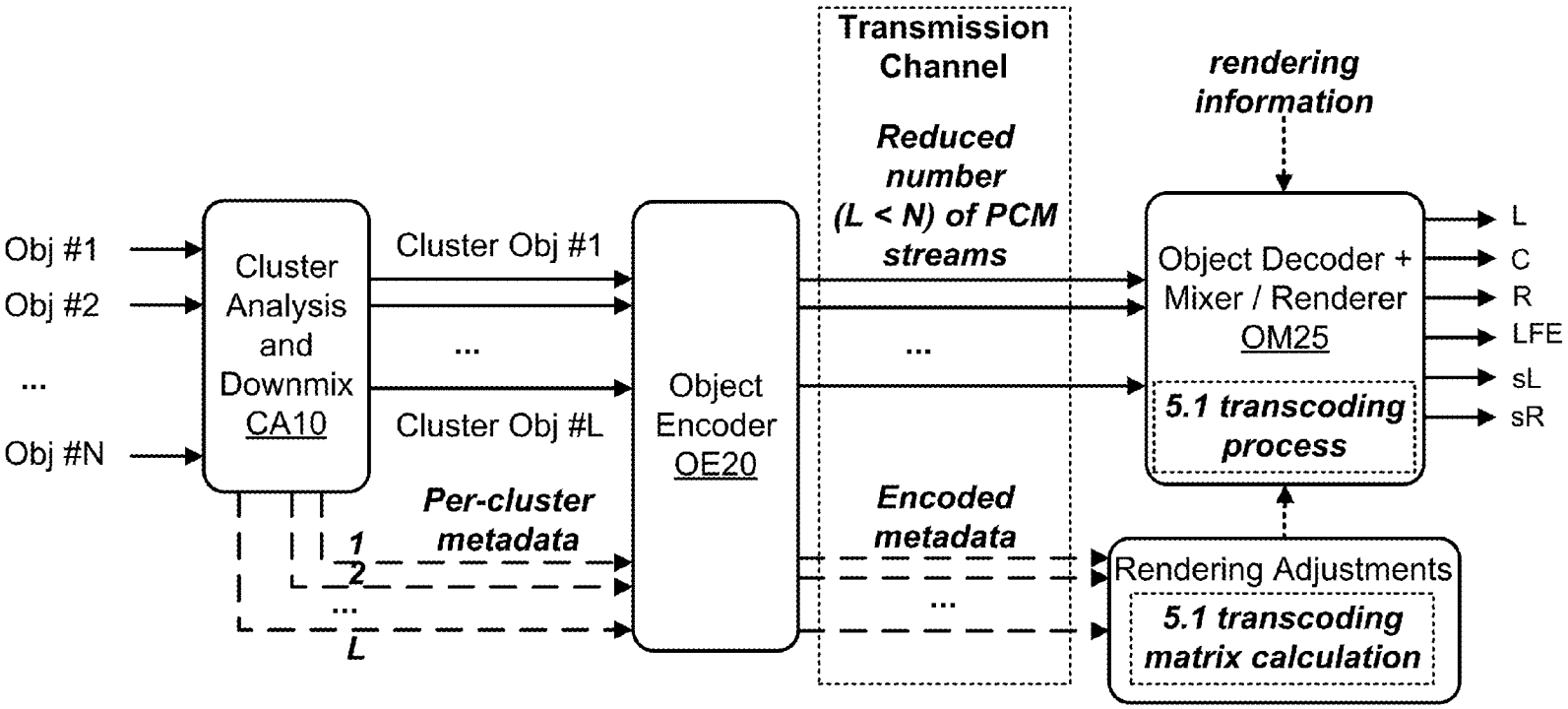

To ensure backward compatibility, it may be desirable to implement such a coding scheme to render one or more legacy outputs (e.g., 5.1 and/or 7.1 surround format). To fulfill this objective (using the 5.1 format as an example), a transcoding matrix from the length-L cluster vector to the length-6 5.1 cluster may be applied, so that the final audio vector $C_{5.1}$ can be obtained according to an expression such as $$C_{5.1}=A_{trans\ 5.1(6\times L)}C,$$

where $A_{trans\ 5.1}$ is the transcoding matrix. The transcoding matrix may be designed and enforced from the encoder side, or it may be calculated and applied at the decoder side. FIGS. 8 and 9 show examples of these two approaches.

FIG. 8 shows an example in which the transcoding matrix is encoded in the metadata by an implementation CA20 of downmixer CA10 (e.g., by an implementation of task T300) for application by an implementation OM25 of mixer OM20. In this case, the transcoding matrix can be low-rate data in metadata, so the desired downmix (or upmix) design to 5.1 can be specified at the encoder end while not increasing much data. FIG. 9 shows an example in which the transcoding matrix is calculated by the decoder (e.g., by an implementation of task T400).

The legacy-compatible channel signals produced by the transcoding matrix may be carried as linear PCM streams by an HDMI interface (High-Definition Multimedia Interface, HDMI Licensing, LLC, Sunnyvale, Calif.). In another example, task T200 may be implemented to store the channel signals as linear PCM streams on an optical disc, such as a CD, DVD, DVD-Audio, or Blu-Ray disc. A Blu-Ray disc (e.g., an optical data storage medium compliant with the Blu-Ray Disc Application Definition BD-J, March 2005, Blu-Ray Disc Association, www-dot-blu-raydisc-dot-com) may include a file 'zzzzz.m2ts' that contains an MPEG-2 transport stream, where 'zzzzz' is a five-digit number that associates the AV stream file with a clip information file. The stream file 'zzzzz.m2ts' may include multiple elementary audio streams. Task T200 may be implemented to produce such a stream file that includes time-domain versions of the channel signals as LPCM streams.

To reduce use of bandwidth and/or storage resources, it may be desirable to implement task T200 to compress the LPCM channel streams. To ensure recoverability of the cluster streams without error, it may be desirable to perform such compression using a lossless compression scheme. In one example, task T200 is implemented to encode the PCM streams using Meridian Lossless Packing (MLP) to produce a bitstream that is compliant with the DVD-Audio. In another example, task T200 is implemented to encode the PCM streams using the MPEG-4 SLS (Scalable to Lossless) lossless extension to the AAC core codec. In a further example, task T200 is implemented to produce a stream file (e.g., a Blu-Ray-compliant m2ts file as described above) that includes elementary audio streams produced by losslessly encoding the PCM streams using Dolby TrueHD, which encodes 7.1 audio using an improved version of MLP, and/or DTS-HD Master Audio (DTS, Inc., Calabasas, Calif.), which also encodes 7.1 audio with a lossless option.

Task T200 may be otherwise implemented to encode the channel signals into backward-compatible coded signals that describe the channel signals. Such encoding may include performing a lossy compression scheme on the channel signals. Examples of backward-compatible codecs that may be used in such implementations of task T200 include AC3 (e.g., as described in ATSC Standard: Digital Audio Compression, Doc. A/52:2012, 23 Mar. 2012, Advanced Television Systems Committee, Washington, D.C.; also called ATSC A/52 or Dolby Digital, which uses lossy MDCT compression), Dolby TrueHD (which includes lossy compression options), DTS-HD Master Audio (which also includes lossy compression options), and MPEG Surround. These codecs typically accept time-domain channel signals (e.g., a set of linear PCM streams) as input. Such transcoding allows the channel signals to retain backward compatibility with AC3 decoders that are in many consumer devices and set-top boxes. For example, the encoded channels may be packed into a corresponding portion of a packet that is compliant with a desired corresponding channel-based format.

In such cases, task T300 may be implemented to encode the transcoding matrix and the downmixed metadata in one or more extended portions of the transcoded bitstream (e.g., an "auxdata" portion of an AC3 packet and/or an extension (type B) packet of a Dolby Digital Plus bitstream). It is also possible for such an implementation of method M100 to include two or more different transcoding operations, each coding the multichannel signal into a different respective format (e.g., an AC3 transcoding and a Dolby TrueHD transcoding), to produce two different backward-compatible bitstreams for transmission and/or storage.

Figure 10:
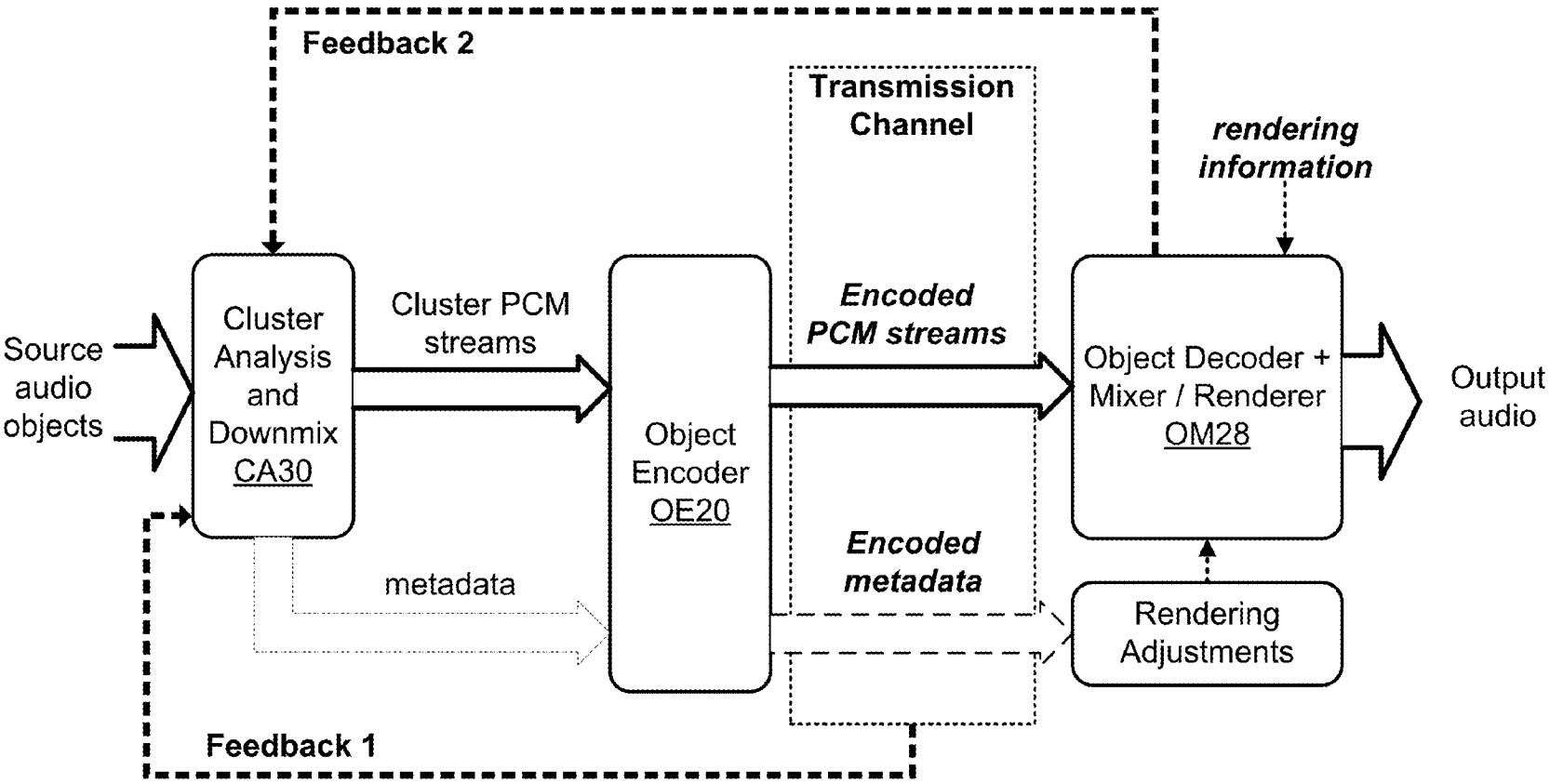
FIG. 10 shows a feedback design for cluster analysis update.

Situations may arise in which it becomes desirable to update the cluster analysis parameters. As time passes, it may be desirable for the encoder to obtain knowledge from different nodes of the system. FIG. 10 illustrates one example of a feedback design concept.

As shown in FIG. 10, during a communication type of real-time coding (e.g., a 3D audio conference with multiple talkers as the audio source objects), Feedback 1 can monitor and report the current channel condition in the transmission channel. To an implementation CA30 of analyzer and downmixer CA10. When the channel capacity decreases, it may be desirable to reduce the maximum number of designated cluster count, so that the data rate is reduced in the encoded PCM channels.

In other cases, a decoder CPU may be busy running other tasks, causing the decoding speed to slow down and become the system bottleneck. The decoder (shown here in an implementation OM28 of mixer OM20) may transmit such information (e.g., an indication of decoder CPU load) back to the encoder as Feedback 2, and the encoder may reduce the number of clusters in response. The output channel configuration or speaker setup can also change during decoding; such a change may be indicated by Feedback 2 and the encoder end will update accordingly. In another example, Feedback 2 carries an indication of the user's current head orientation, and the encoder performs the clustering according to this information (e.g., to apply a direction dependence with respect to the new orientation). Other types of feedback that may be carried back from a decoder or renderer include information about the local rendering environment, such as the number of loudspeakers, the room response, reverberation, etc. An encoding system may be implemented to respond to either or both types of feedback (i.e., to Feedback 1 and/or to Feedback 2), and likewise a decoding system may be implemented to provide either or both of these types of feedback.

As noted above, a maximum number of clusters may be specified according to the transmission channel capacity and/or intended bit rate. In one non-limiting example, the relationship between the selected bit rate and the maximum number of clusters is linear. In this example, if a bit rate A is half of a bit rate B, then the maximum number of clusters associated with bit rate A (or a corresponding operating point) is half of the maximum number of clusters associated with bit rate B (or a corresponding operating point). Other examples include schemes in which the maximum number of clusters decreases slightly more than linearly with bit rate (e.g., to account for a proportionally larger percentage of overhead).

Alternatively or additionally, a maximum number of clusters may be based on feedback received from the channel and/or from a decoder and/or renderer. In one example, feedback from the channel (e.g., Feedback 1) is provided by a network entity that indicates a channel capacity and/or detects congestion (e.g., monitors packet loss). Such feedback may be implemented, for example, via RTCP messaging (Real-Time Transport Control Protocol, as defined in, e.g., the Internet Engineering Task Force (IETF) specification RFC 3550, Standard 64 (July 2003)), which may include transmitted octet counts, transmitted packet counts, expected packet counts, number and/or fraction of packets lost, jitter (e.g., variation in delay), and round-trip delay.

Feedback information from a decoder or renderer (e.g., Feedback 2) may be provided by a client program in a terminal computer that requests a particular bit rate. Such a request may be a result of a negotiation to determine transmission channel capacity. In another example, feedback information received from the channel and/or from a decoder and/or renderer is used to indicate the maximum number of clusters as described above.

It may be common that the capacity of the transmission channel will limit the maximum number of clusters. Such a constraint may be implemented such that the maximum number of clusters depends directly on a measure of channel capacity, or indirectly such that a bit rate, selected according to an indication of channel capacity, is used to obtain the maximum number of clusters as described herein.

The above are non-limiting examples of having a feedback mechanism built in the system. Additional implementations may include other design details and functions.

As noted above, the L clustered streams may be produced as WAV files or PCM streams with accompanying metadata. Alternatively, it may be desirable, for one or more (possibly all) of the L clustered streams, to use a hierarchical set of elements to represent the sound field described by a stream and its metadata. A hierarchical set of elements is a set in which the elements are ordered such that a basic set of lower-ordered elements provides a full representation of the modeled sound field. As the set is extended to include higher-order elements, the representation becomes more detailed. One example of a hierarchical set of elements is a set of coefficients of spherical harmonic basis functions (also called spherical harmonic coefficients or SHC).

In this approach, the clustered streams are transformed by projecting them onto a set of basis functions (e.g., a set of orthogonal basis functions) to obtain a hierarchical set of basis function coefficients. In one such example, each stream is transformed by projecting it onto a set of spherical harmonic basis functions to obtain a set of SHC. Such an operation may be performed on each frame of the stream, for example, by performing a fast Fourier transform on the frame to obtain a corresponding frequency-domain vector and projecting the vector onto the set of basis functions to obtain a set of SHC for the frame. Other examples of hierarchical sets include sets of wavelet transform coefficients and other sets of coefficients of multiresolution basis functions.

The coefficients generated by such a transform have the advantage of being hierarchical (i.e., having a defined order relative to one another), making them amenable to scalable coding. The number of coefficients that are transmitted (and/or stored) may be varied, for example, in proportion to the available bandwidth (and/or storage capacity). In such case, when higher bandwidth (and/or storage capacity) is available, more coefficients can be transmitted, allowing for greater spatial resolution during rendering. Such transformation also allows the number of coefficients to be independent of the number of objects that make up the sound field, such that the bit-rate of the representation may be independent of the number of audio objects that were used to construct the sound field.

The following expression shows an example of how a PCM object $s_i(t)$, along with its metadata (containing location co-ordinates, etc.), may be transformed into a set of SHC:

$$s_i(t, r_l, \theta_l, \varphi_l) = \sum_{\omega=0}^{\infty}\left[\sum_{n=0}^{\infty} j_n(kr_l)\sum_{m=-n}^{n} A_n^m(k)Y_n^m(\theta_l, \varphi_l)\right]e^{j\omega t}, \quad (1)$$

where the wavenumber $$k = \frac{\omega}{c}, c$$

is the speed of sound (~343 m/s), $\{r_l, \theta_l, \phi_l\}$ is a point of reference (or observation point) within the sound field, $j_n(\bullet)$ is the spherical Bessel function of order n, and $Y_n^m(\theta_l, \phi_l)$ are the spherical harmonic basis functions of order n and suborder m (some descriptions of SHC label n as degree (i.e. of the corresponding Legendre polynomial) and m as order). It can be recognized that the term in square brackets is a frequency-domain representation of the signal (i.e., $S(\omega, r_l, \theta_l, \phi_l)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

A sound field may be represented in terms of SHC using an expression such as the following:

$$p_i(t, r_l, \theta_l, \varphi_l) = \sum_{\omega=0}^{\infty}\left[4\pi\sum_{n=0}^{\infty} j_n(kr_l)\sum_{m=-n}^{n} A_n^m(k)Y_n^m(\theta_l, \varphi_l)\right]e^{j\omega t}, \quad (2)$$

This expression shows that the pressure $p_i$ at any point $\{r_l, \theta_l, \phi_l\}$ of the sound field can be represented uniquely by the SHC $A_n^m(k)$.

Figure 11:
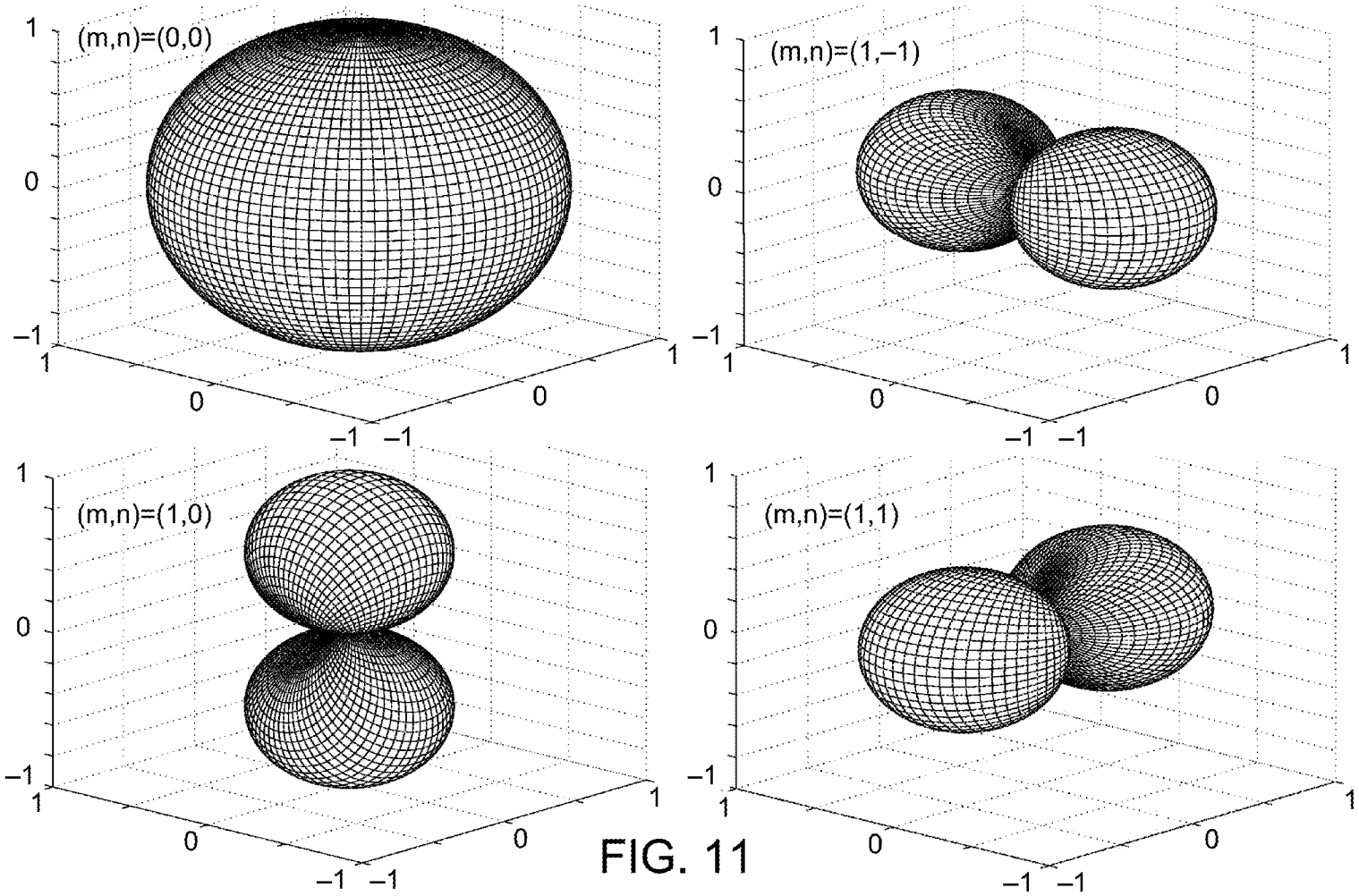
FIG. 11 shows examples of surface mesh plots of the magnitudes of spherical harmonic basis functions of order 0 and 1.

FIG. 11 shows examples of surface mesh plots of the magnitudes of spherical harmonic basis functions of order 0 and 1. The magnitude of the function $Y_0^0$ is spherical and omnidirectional. The function $Y_1^{-1}$ has positive and negative spherical lobes extending in the +y and −y directions, respectively. The function $Y_1^0$ has positive and negative spherical lobes extending in the +z and −z directions, respectively. The function $Y_1^1$ has positive and negative spherical lobes extending in the +x and −x directions, respectively.

Figure 12:
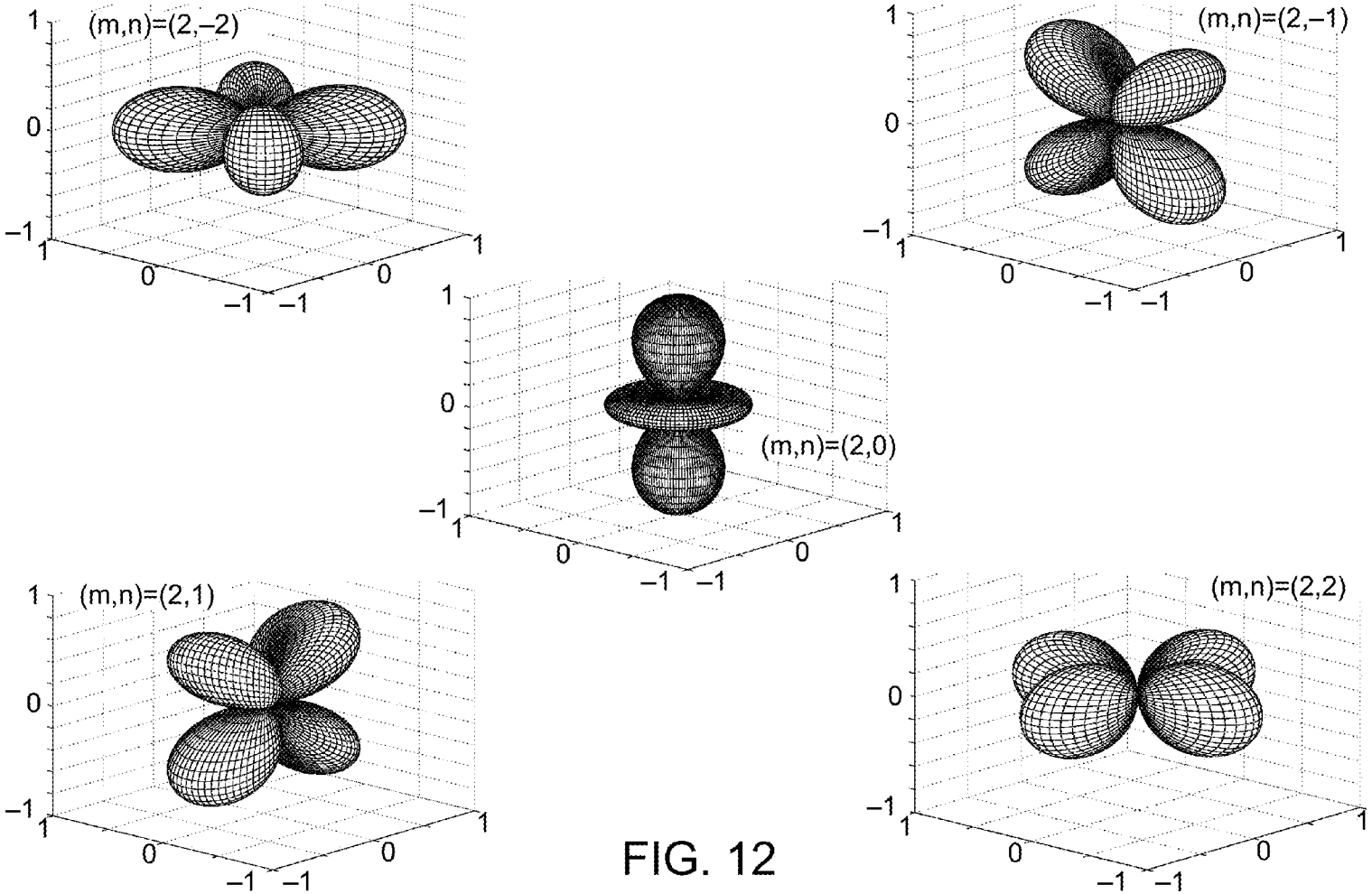
FIG. 12 shows examples of surface mesh plots of the magnitudes of spherical harmonic basis functions of order 2.

FIG. 12 shows examples of surface mesh plots of the magnitudes of spherical harmonic basis functions of order 2. The functions $Y_2^{-2}$ and $Y_2^2$ have lobes extending in the x-y plane. The function $Y_2^{-1}$ has lobes extending in the y-z plane, and the function $Y_2^1$ has lobes extending in the x-z plane. The function $Y_2^0$ has positive lobes extending in the +z and −z directions and a toroidal negative lobe extending in the x-y plane.

The SHC $A_n^m(k)$ for the sound field corresponding to an individual audio object or cluster may be expressed as $$A_n^m(k)=g(\omega)(-4\pi ik)h_n^{(2)}(kr_s)Y_n^{m*}(\theta_s,\phi_s), \quad (3)$$

where i is $\sqrt{-1}$ and $h_n^{(2)}(\bullet)$ is the spherical Hankel function (of the second kind) of order n. Knowing the source energy g (ω) as a function of frequency allows us to convert each PCM object and its location $\{r_s, \theta_s, \phi_s\}$ into the SHC $A_n^m(k)$. This source energy may be obtained, for example, using time-frequency analysis techniques, such as by performing a fast Fourier transform (e.g., a 256-, 512-, or 1024-point FFT) on the PCM stream. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_l, \theta_l, \phi_l\}$. The total number of SHC to be used may depend on various factors, such as the available bandwidth.

One of skill in the art will recognize that representations of coefficients $A_n^m$ (or, equivalently, of corresponding time-domain coefficients $a_n^m$) other than the representation shown in expression (3) may be used, such as representations that do not include the radial component. One of skill in the art will recognize that several slightly different definitions of spherical harmonic basis functions are known (e.g., real, complex, normalized (e.g., N3D), semi-normalized (e.g., SN3D), Furse-Malham (FuMa or FMH), etc.), and consequently that expression (2) (i.e., spherical harmonic decomposition of a sound field) and expression (3) (i.e., spherical harmonic decomposition of a sound field produced by a point source) may appear in the literature in slightly different form. The present description is not limited to any particular form of the spherical harmonic basis functions and indeed is generally applicable to other hierarchical sets of elements as well.

Figure 13B:
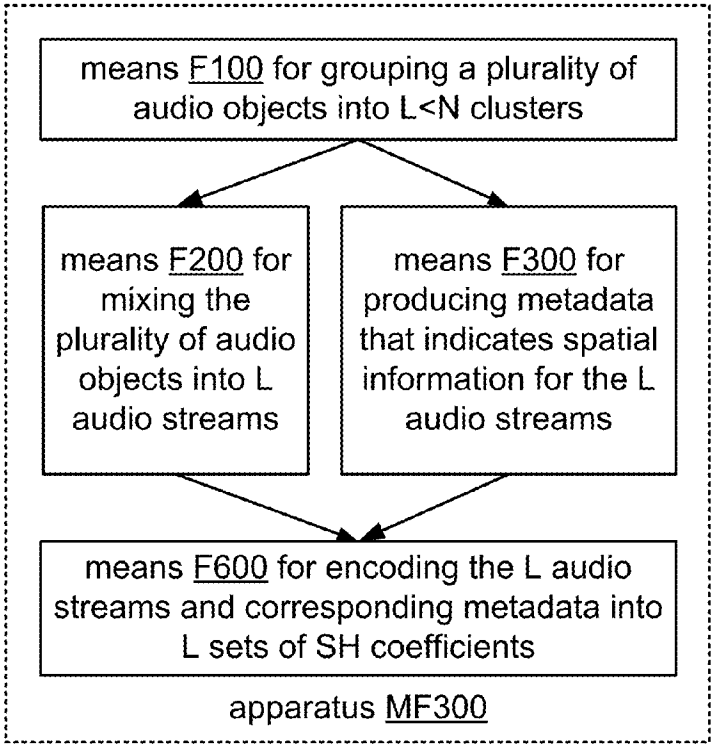
FIG. 13B shows a block diagram of an apparatus MF300 according to a general configuration.
Figure 13A:
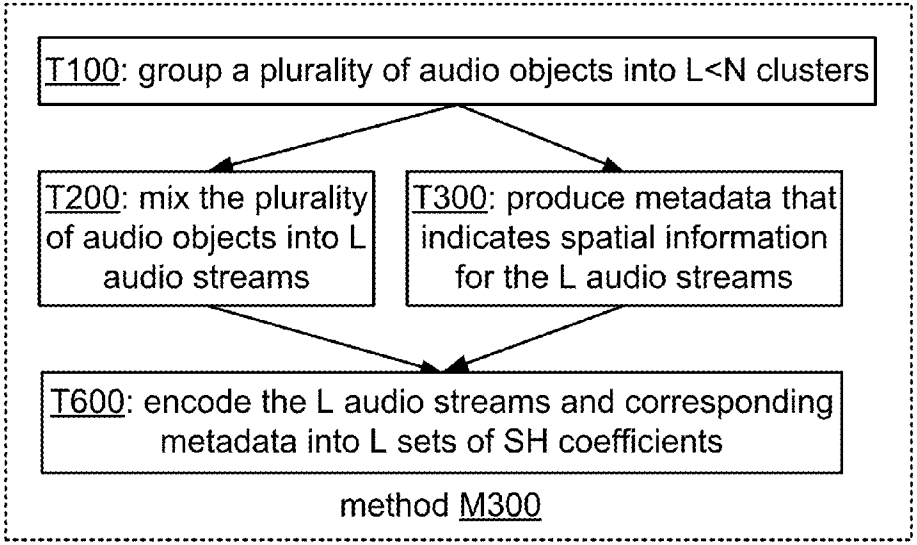
FIG. 13A shows a flowchart for an implementation M300 of method M100.

FIG. 13A shows a flowchart for an implementation M300 of method M100. Method M300 includes a task T600 that encodes the L audio streams and corresponding spatial information into L sets of SHC.

Figure 14A:
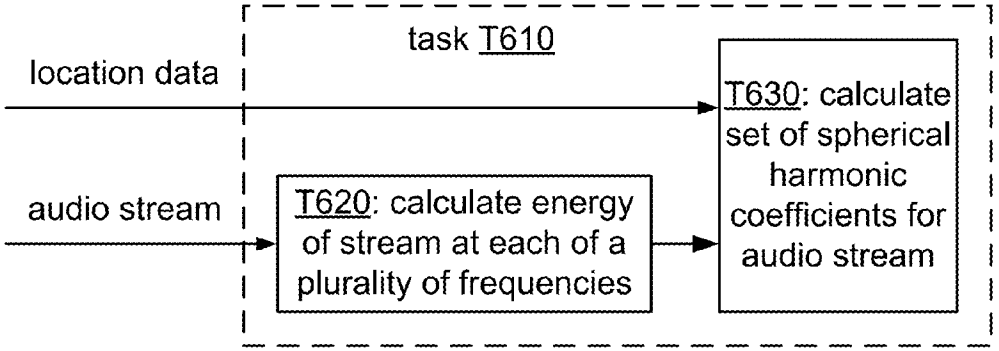
FIG. 14A shows a flowchart for a task T610.
Figure 14B:
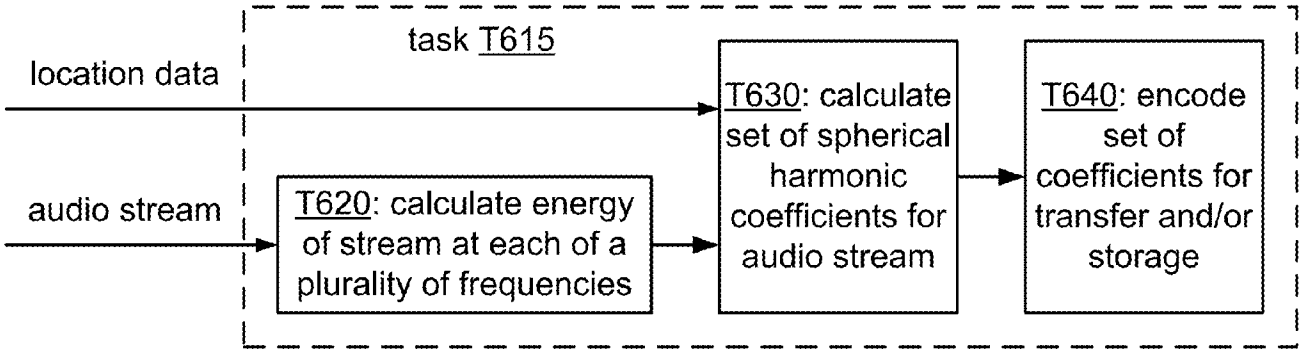
FIG. 14B shows a flowchart of an implementation T615 of task T610.

FIG. 14A shows a flowchart for a task T610 that includes subtasks T620 and T630. Task T620 calculates an energy g (ω) of the object at each of a plurality of frequencies (e.g., by performing a fast Fourier transform on the object's PCM stream). Based on the calculated energies and location data for the stream, task T630 calculates a set of SHC (e.g., a B-Format signal). FIG. 14B shows a flowchart of an implementation T615 of task T610 that includes task T640, which encodes the set of SHC for transmission and/or storage. Task T600 may be implemented to include a corresponding instance of task T610 (or T615) for each of the L audio streams.

Task T600 may be implemented to encode each of the L audio streams at the same SHC order. This SHC order may be set according to the current bit rate or operating point. In one such example, selection of a maximum number of clusters as described herein (e.g., according to a bit rate or operating point) may include selection of one among a set of pairs of values, such that one value of each pair indicates a maximum number of clusters and the other value of each pair indicates an associated SHC order for encoding each of the L audio streams.

The number of coefficients used to encode an audio stream (e.g., the SHC order, or the number of the highest-order coefficient) may be different from one stream to another. For example, the sound field corresponding to one stream may be encoded at a lower resolution than the sound field corresponding to another stream. Such variation may be guided by factors that may include, for example, the importance of the object to the presentation (e.g., a foreground voice vs. a background effect), location of the object relative to the listener's head (e.g., object to the side of the listener's head are less localizable than objects in front of the listener's head and thus may be encoded at a lower spatial resolution), location of the object relative to the horizontal plane (the human auditory system has less localization ability outside this plane than within it, so that coefficients encoding information outside the plane may be less important than those encoding information within it), etc. In one example, a highly detailed acoustic scene recording (e.g., a scene recorded using a large number of individual microphones, such as an orchestra recorded using a dedicated spot microphone for each instrument) is encoded at a high order (e.g., tenth-order or above, such as up to 100th-order or more) to provide a high degree of resolution and source localizability.

In another example, task T600 is implemented to obtain the SHC order for encoding an audio stream according to the associated spatial information and/or other characteristic of the sound. For example, such an implementation of task T600 may be configured to calculate or select the SHC order based on information such as, e.g., diffusivity of the component objects and/or diffusivity of the cluster as indicated by the downmixed metadata. In such cases, task T600 may be implemented to select the individual SHC orders according to an overall bit-rate or operating-point constraint, which may be indicated by feedback from the channel, decoder, and/or renderer as described herein.

Figure 15A:
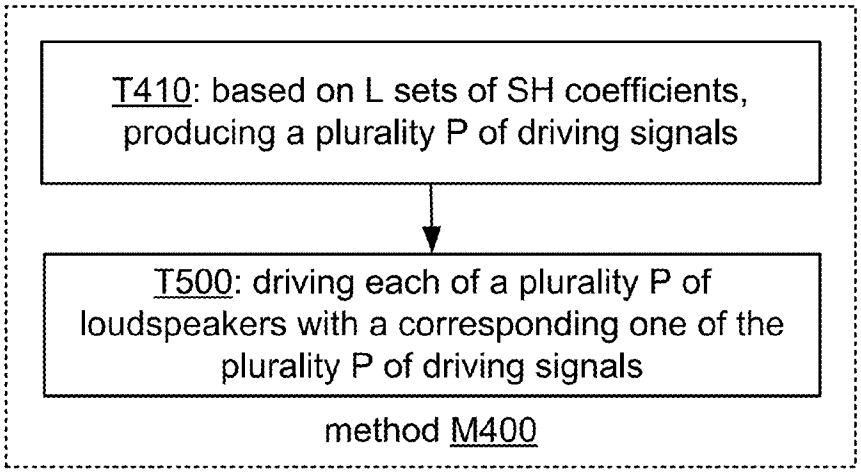
FIG. 15A shows a flowchart of an implementation M400 of method M200.

FIG. 15A shows a flowchart of an implementation M400 of method M200 that includes an implementation T410 of task T400. Based on L sets of SH coefficients, task T410 produces a plurality P of driving signals, and task T500 drives each of a plurality P of loudspeakers with a corresponding one of the plurality P of driving signals.

Figure 18:
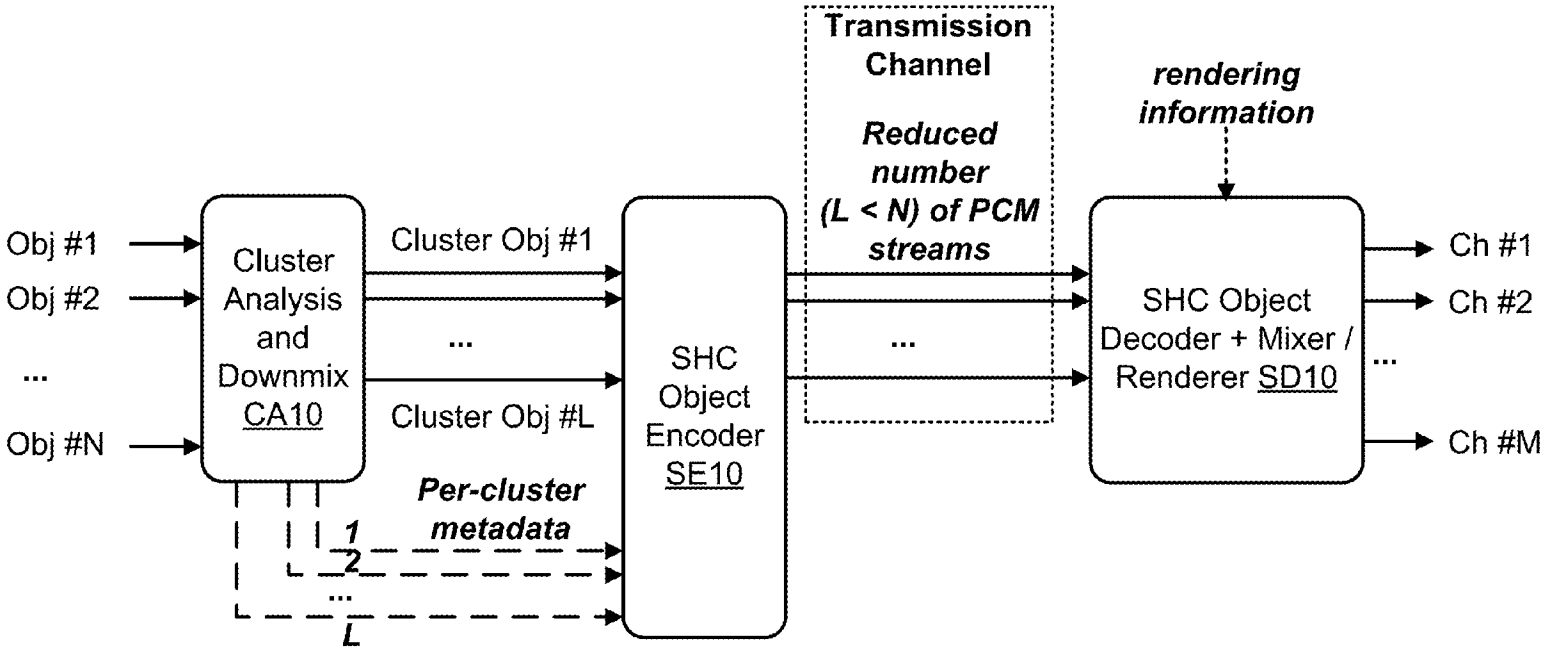
FIGS. 18-20 show conceptual diagrams of systems similar to those shown in FIGS. 7, 9, and 10.
Figure 19:
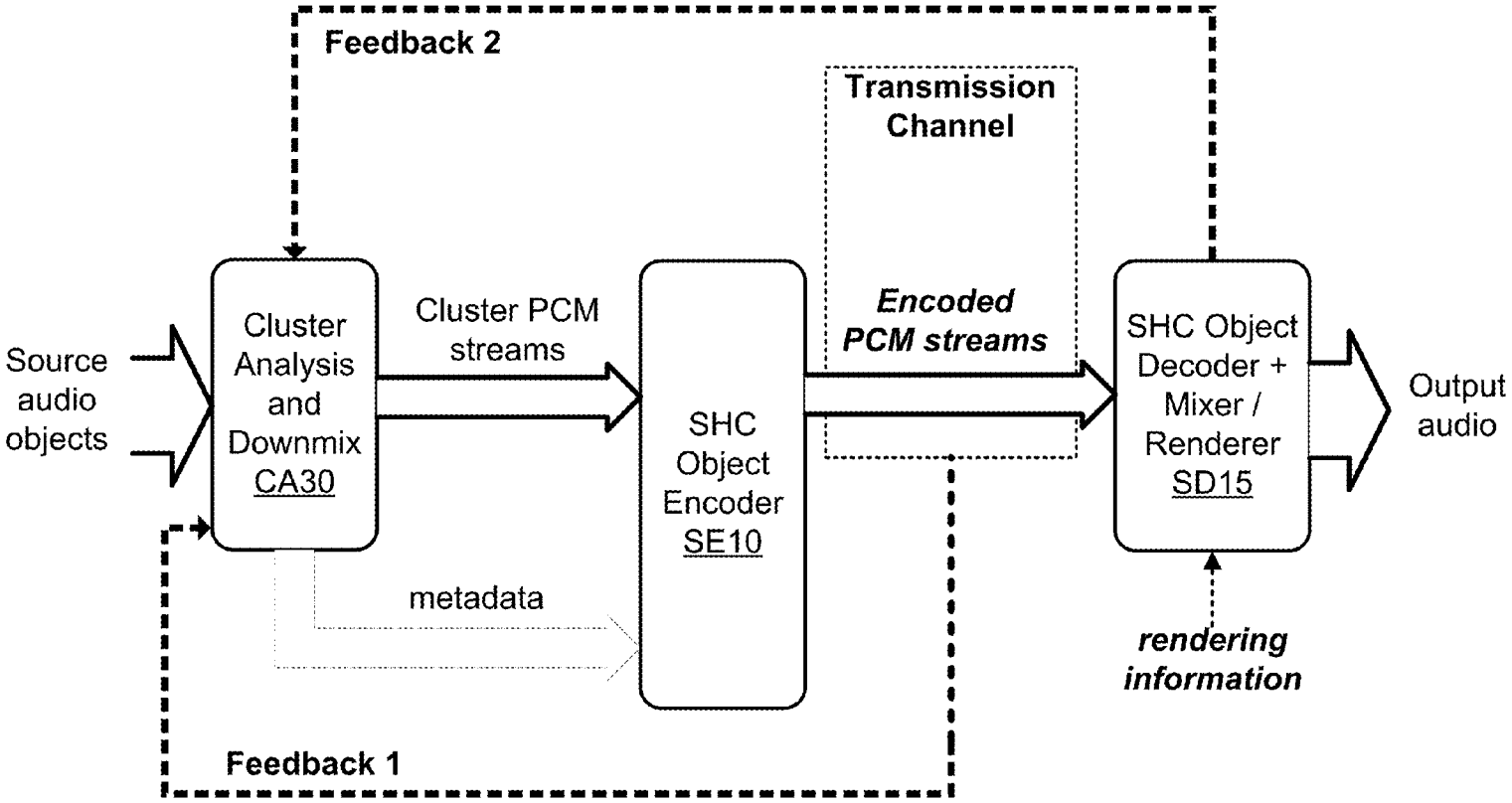
Figure 20:
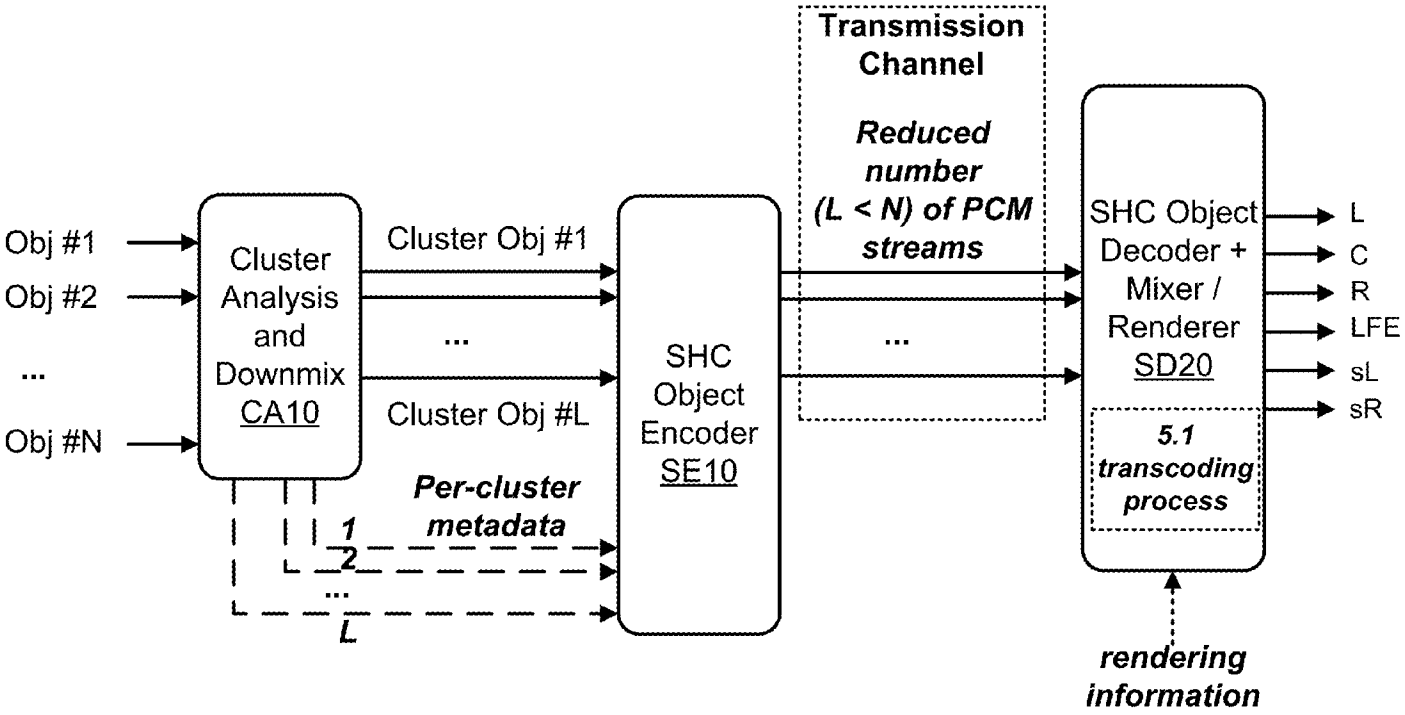

FIGS. 18-20 show conceptual diagrams of systems as shown in FIGS. 7, 10, and 9, respectively, that include a cluster analyzer and downmixer CA10 (and an implementation CA30 thereof) that may be implemented to perform method M300, and a mixer/renderer SD10 (and implementations SD15 and SD20 thereof) that may be implemented to perform method M400. This example also includes a codec as described herein that comprises an SHC object encoder SE10 configured to encode the L SHC objects and an object decoder within mixer/renderer SD10 that is configured to decode the L SHC objects.

As an alternative to encoding the L audio streams after clustering, it may be desirable to transform each of the audio objects, before clustering, into a set of SHC. In such case, a clustering method as described herein may include performing the cluster analysis on the sets of SHC (e.g., in the SHC domain rather than the PCM domain).

Figure 16A:
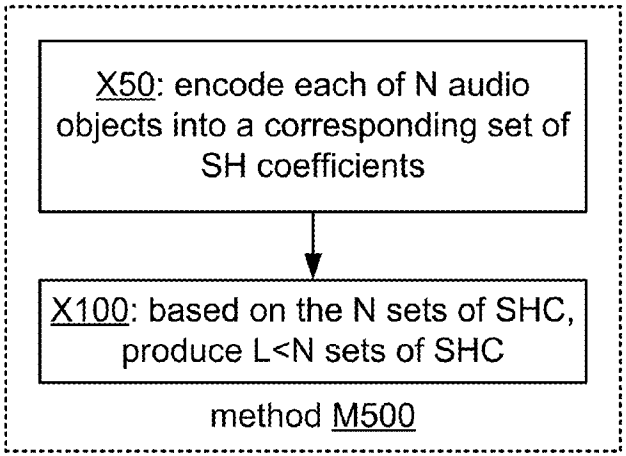
FIG. 16A shows a flowchart for a method M500 according to a general configuration.

FIG. 16A shows a flowchart for a method M500 according to a general configuration that includes tasks X50 and X100. Task X50 encodes each of the N audio objects into a corresponding set of SHC. For a case in which each object is an audio stream with corresponding location data, task X50 may be implemented according to the description of task T600 herein (e.g., as multiple implementations of task T610).

Task X50 may be implemented to encode each object at a fixed SHC order (e.g., second-, third-, fourth-, or fifth-order or more). Alternatively, task X50 may be implemented to encode each object at an SHC order that may vary from one object to another based on one or more characteristics of the sound (e.g., diffusivity of the object, as may be indicated by the spatial information associated with the object). Such a variable SHC order may also be subject to an overall bit-rate or operating-point constraint, which may be indicated by feedback from the channel, decoder, and/or renderer as described herein.

Figure 16B:
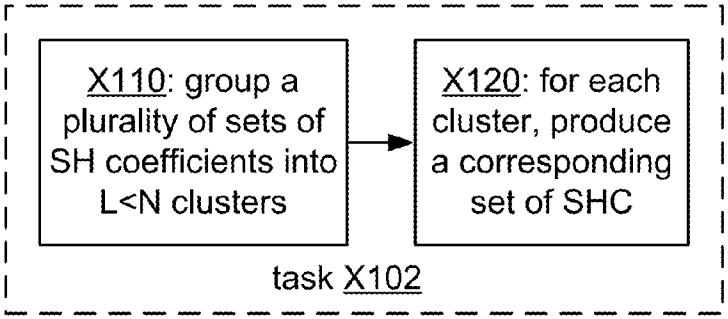
FIG. 16B shows a flowchart of an implementation X102 of task X100.

Based on a plurality of at least N sets of SHC, task X100 produces L sets of SHC, where L is less than N. The plurality of sets of SHC may include, in addition to the N sets, one or more additional objects that are provided in SHC form. FIG. 16B shows a flowchart of an implementation X102 of task X100 that includes subtasks X110 and X120. Task X110 groups a plurality of sets of SHC (which plurality includes the N sets of SHC) into L clusters. For each cluster, task X120 produces a corresponding set of SHC. Task X120 may be implemented, for example, to produce each of the L clustered objects by calculating a sum (e.g., a coefficient vector sum) of the SHC of the objects assigned to that cluster to obtain a set of SHC for the cluster. In another implementation, task X120 may be configured to concatenate the coefficient sets of the component objects instead.

For a case in which the N audio objects are provided in SHC form, of course, task X50 may be omitted and task X100 may be performed on the SHC-encoded objects. For an example in which the number N of objects is one hundred and the number L of clusters is ten, such a task may be applied to compress the objects into only ten sets of SHC for transmission and/or storage, rather than one hundred.

Task X100 may be implemented to produce the set of SHC for each cluster to have a fixed order (e.g., second-, third-, fourth-, or fifth-order or more). Alternatively, task X100 may be implemented to produce the set of SHC for each cluster to have an order that may vary from one cluster to another based on, e.g., the SHC orders of the component objects (e.g., a maximum of the object SHC orders, or an average of the object SHC orders, which may include weighting of the individual orders by, e.g., magnitude and/or diffusivity of the corresponding object).

The number of SH coefficients used to encode each cluster (e.g., the number of the highest-order coefficient) may be different from one cluster to another. For example, the sound field corresponding to one cluster may be encoded at a lower resolution than the sound field corresponding to another cluster. Such variation may be guided by factors that may include, for example, the importance of the cluster to the presentation (e.g., a foreground voice vs. a background effect), location of the cluster relative to the listener's head (e.g., object to the side of the listener's head are less localizable than objects in front of the listener's head and thus may be encoded at a lower spatial resolution), location of the cluster relative to the horizontal plane (the human auditory system has less localization ability outside this plane than within it, so that coefficients encoding information outside the plane may be less important than those encoding information within it), etc.

Figure 16C:
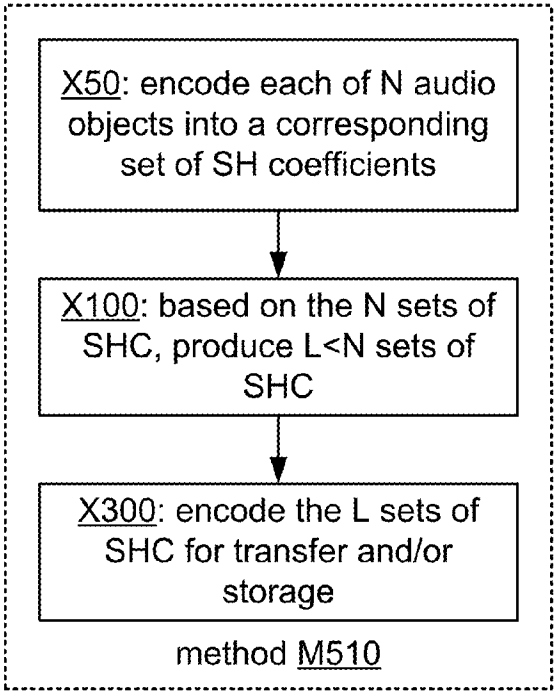
FIG. 16C shows a flowchart of an implementation M510 of method M500.

Encoding of the SHC sets produced by method M300 (e.g., task T600) or method M500 (e.g., task X100) may include one or more lossy or lossless coding techniques, such as quantization (e.g., into one or more codebook indices), error correction coding, redundancy coding, etc., and/or packetization. Additionally or alternatively, such encoding may include encoding into an Ambisonic format, such as B-format, G-format, or Higher-order Ambisonics (HOA). FIG. 16C shows a flowchart of an implementation M510 of method M500 which includes a task X300 that encodes the N sets of SHC (e.g., individually or as a single block) for transmission and/or storage.

Figure 21:
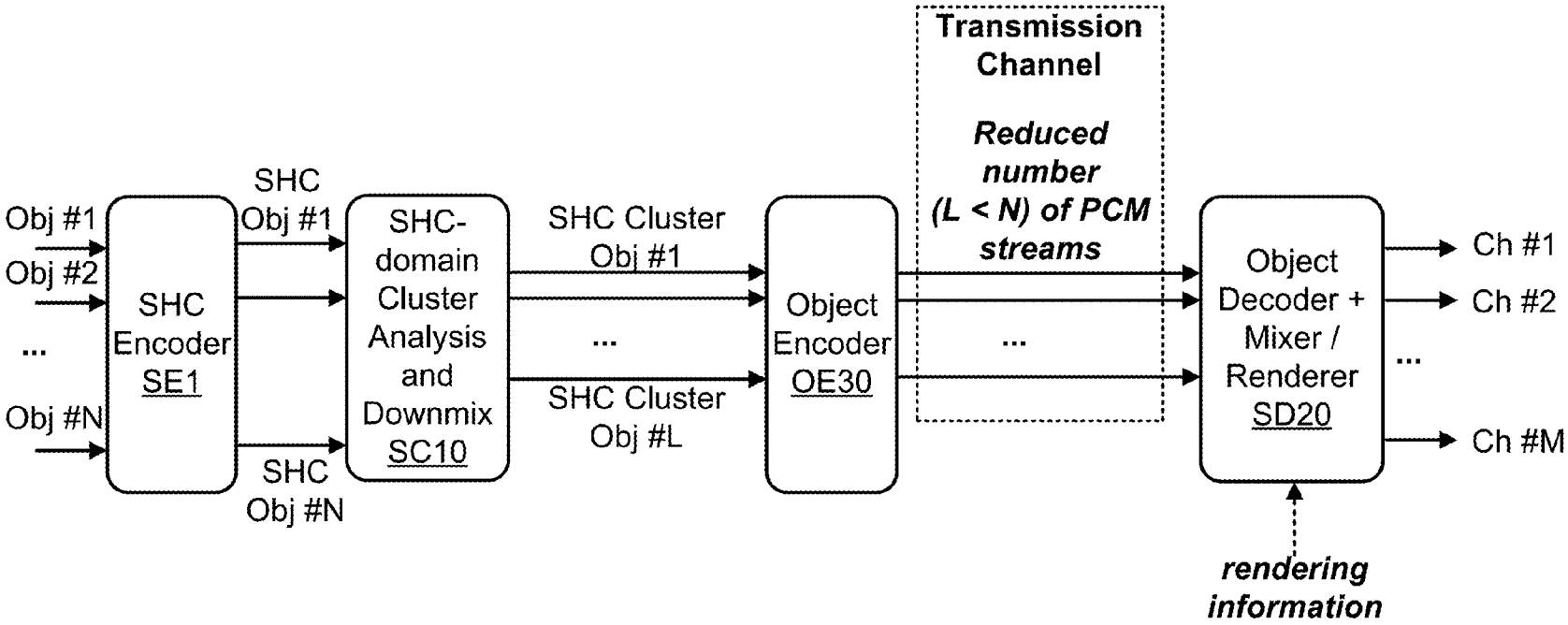
FIGS. 21-23 show conceptual diagrams of systems similar to those shown in FIGS. 7, 9, and 10.
Figure 22:
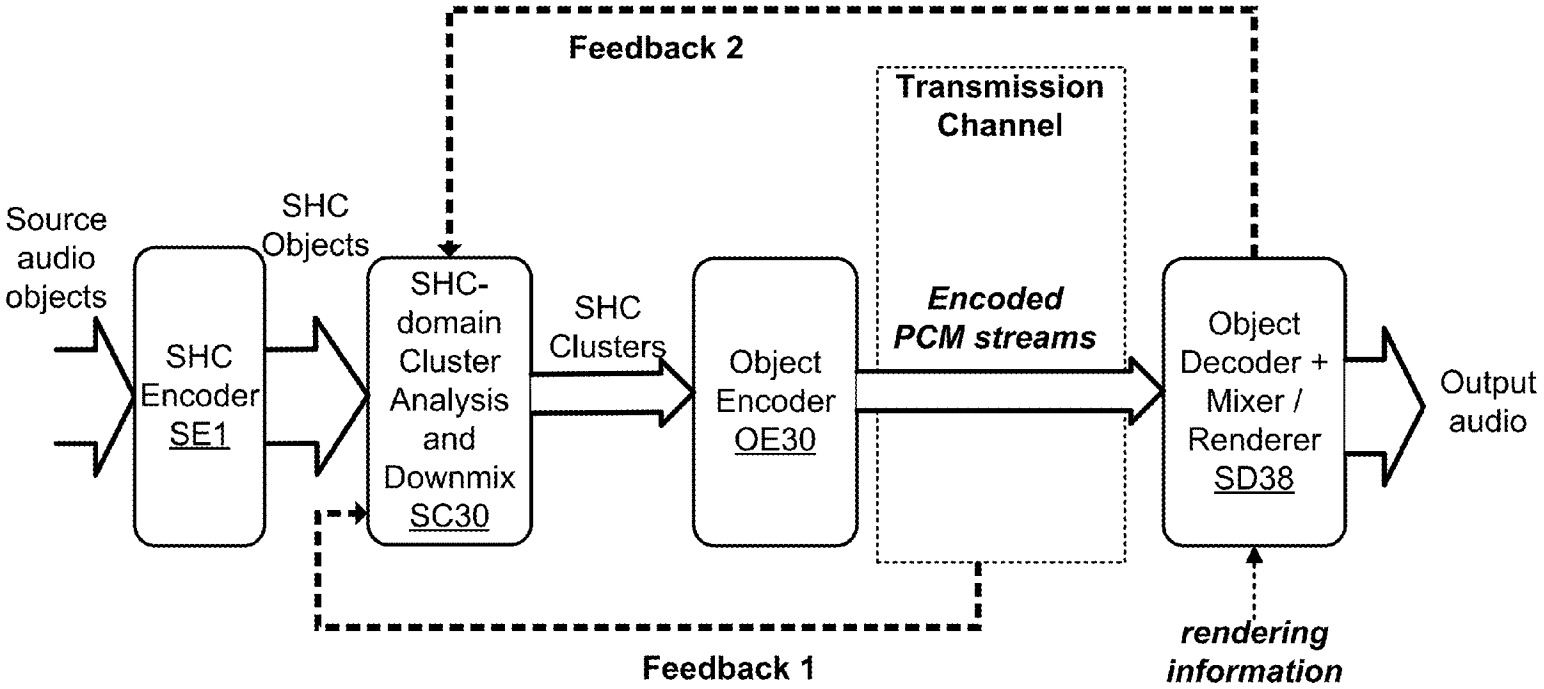
Figure 23:
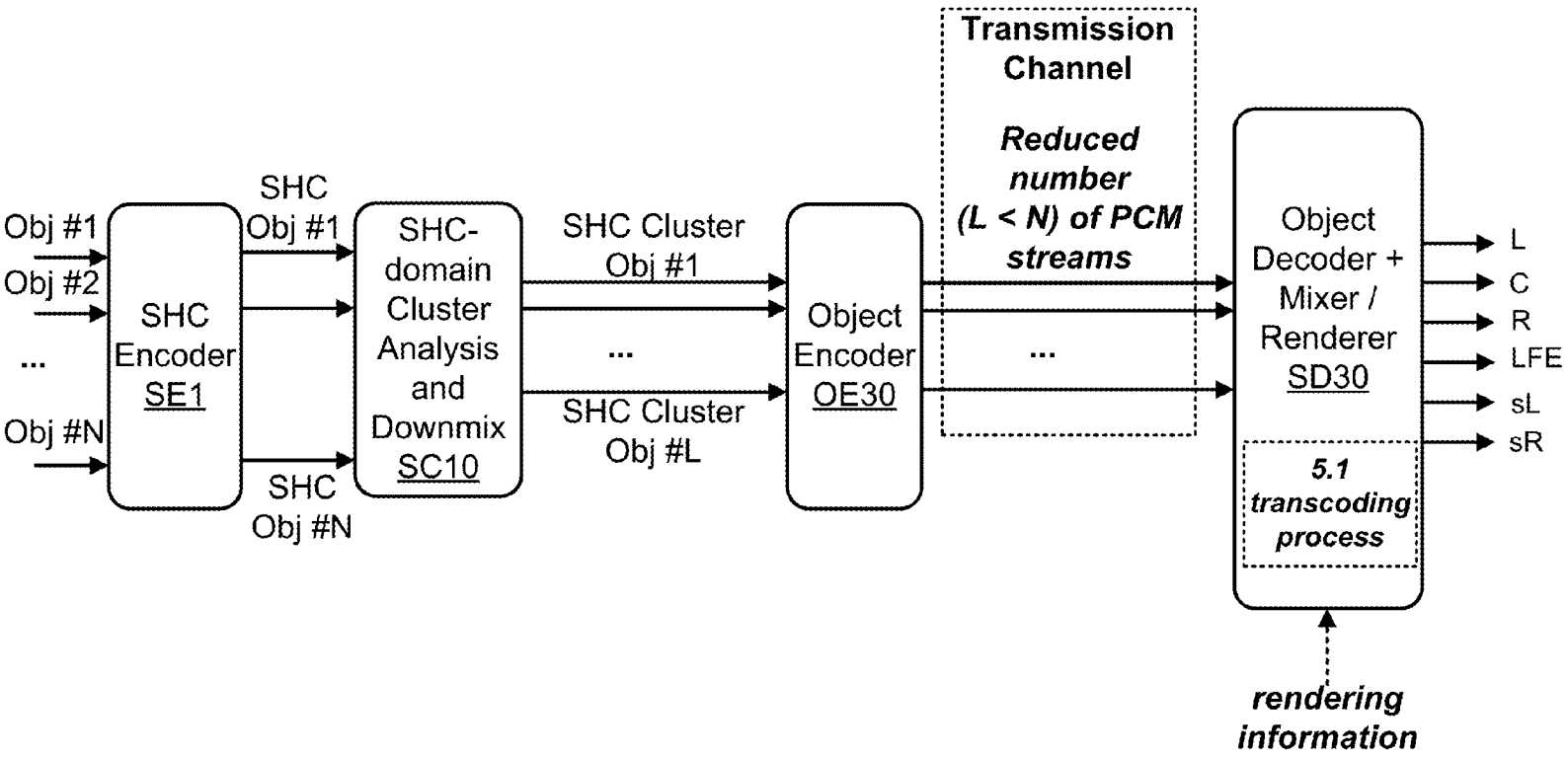

FIGS. 21-23 show conceptual diagrams of systems as shown in FIGS. 7, 10, and 9, respectively, that include a SHC encoder SE1, a cluster analyzer and downmixer SC10 (and an implementation SC30 thereof) that may be implemented to perform method M500, and a mixer/renderer SD20 (and implementations SD30 and SD38 thereof) that may be implemented to perform method M400. This example also includes a codec as described herein that comprises an object encoder OE30 configured to encode the L SHC objects and an object decoder within mixer/renderer SD20 that is configured to decode the L SHC objects.

Potential advantages of such a representation using sets of coefficients of a set of orthogonal basis functions (e.g., SHC) include one or more of the following:

i. The coefficients are hierarchical. Thus, it is possible to send or store up to a certain truncated order (say n=N) to satisfy bandwidth or storage requirements. If more bandwidth becomes available, higher-order coefficients can be sent and/or stored. Sending more coefficients (of higher order) reduces the truncation error, allowing better-resolution rendering.

ii. The number of coefficients is independent of the number of objects—meaning that it is possible to code a truncated set of coefficients to meet the bandwidth requirement, no matter how many objects are in the sound-scene.

iii. The conversion of the PCM object to the SHC is not reversible (at least not trivially). This feature may allay fears from content providers who are concerned about allowing undistorted access to their copyrighted audio snippets (special effects), etc.

iv. Effects of room reflections, ambient/diffuse sound, radiation patterns, and other acoustic features can all be incorporated into the $A_n^m(k)$ coefficient-based representation in various ways.

v. The $A_n^m(k)$ coefficient-based sound field/surround-sound representation is not tied to particular loudspeaker geometries, and the rendering can be adapted to any loudspeaker geometry. Various additional rendering technique options can be found in the literature, for example.

vi. The SHC representation and framework allows for adaptive and non-adaptive equalization to account for acoustic spatio-temporal characteristics at the rendering scene.

An approach as described herein may be used to provide a transformation path for channel- and/or object-based audio that allows a unified encoding/decoding engine for all three formats: channel-, scene-, and object-based audio. Such an approach may be implemented such that the number of transformed coefficients is independent of the number of objects or channels. Such an approach can also be used for either channel- or object-based audio even when an unified approach is not adopted. The format may be implemented to be scalable in that the number of coefficients can be adapted to the available bit-rate, allowing a very easy way to trade-off quality with available bandwidth and/or storage capacity.

The SHC representation can be manipulated by sending more coefficients that represent the horizontal acoustic information (for example, to account for the fact that human hearing has more acuity in the horizontal plane than the elevation/height plane). The position of the listener's head can be used as feedback to both the renderer and the encoder (if such a feedback path is available) to optimize the perception of the listener (e.g., to account for the fact that humans have better spatial acuity in the frontal plane). The SHC may be coded to account for human perception (psychoacoustics), redundancy, etc. An approach as described herein may be implemented as an end-to-end solution (possibly including final equalization in the vicinity of the listener) using, e.g., spherical harmonics.

The spherical harmonic coefficients may be channel-encoded for transmission and/or storage. For example, such channel encoding may include bandwidth compression. At a rendering end, a complementary channel-decoding operation may be performed to recover the spherical harmonic coefficients. A rendering operation including task T410 may then be performed to obtain the loudspeaker feeds for the particular loudspeaker array configuration from the SHC. Task T410 may be implemented to determine a matrix that can convert between the set of SHC and a set of L audio signals corresponding to the loudspeaker feeds for the particular array of L loudspeakers to be used to synthesize the sound field.

One possible method to determine this matrix is an operation known as 'mode-matching'. Here, the loudspeaker feeds are computed by assuming that each loudspeaker produces a spherical wave. In such a scenario, the pressure (as a function of frequency) at a certain position r, θ, φ, due to the t-th loudspeaker, is given by $$P_t(\omega, r, \theta, \varphi) = g_t(\omega)\sum_{n=0}^{\infty} j_n(kr)\sum_{m=-n}^{n}(-4\pi ik)h_n^{(2)}(kr_t)Y_n^{m*}(\theta_t, \varphi_t)Y_n^m(\theta, \varphi), \tag{4}$$

where $\{r_l, \theta_l, \phi_l\}$ represents the position of the l-th loudspeaker and $g_l(\omega)$ is the loudspeaker feed of the l-th speaker (in the frequency domain). The total pressure $P_t$ due to all L speakers is thus given by $$P_t(\omega, r, \theta, \varphi) = \sum_{l=1}^{L} g_l(\omega)\sum_{n=0}^{\infty} j_n(kr)\sum_{m=-n}^{n}(-4\pi ik)h_n^{(2)}(kr_l)Y_n^{m*}(\theta_l, \varphi_l)Y_n^m(\theta, \varphi). \tag{5}$$

We also know that the total pressure in terms of the SHC is given by the equation $$P_t(\omega, r, \theta, \varphi) = 4\pi\sum_{n=0}^{\infty} j_n(kr)\sum_{m=-n}^{n} A_n^m(k)Y_n^m(\theta, \varphi). \tag{6}$$

Task T410 may be implemented to render the modeled sound field by solving an expression such as the following to obtain the loudspeaker feeds $g_l(\omega)$:

$$\begin{bmatrix} A_0^0(\omega) \\ A_1^1(\omega) \\ A_1^{-1}(\omega) \\ A_2^2(\omega) \\ A_2^{-2}(\omega) \end{bmatrix} = \tag{7}$$

-continued $$-ik\begin{bmatrix} h_0^{(2)}(kr_1)Y_0^{0*}(\theta_1,\varphi_1) & h_0^{(2)}(kr_2)Y_0^{0*}(\theta_2,\varphi_2). & \dots & \dots & \dots \\ h_1^{(2)}(kr_1)Y_1^{1*}(\theta_1,\varphi_1). & \dots & \dots & \dots & \dots \\ \dots & \dots & \dots & \dots & \dots \\ \dots & \dots & \dots & \dots & \dots \\ \dots & \dots & \dots & \dots & \dots \end{bmatrix}\begin{bmatrix} g_1(\omega) \\ g_2(\omega) \\ g_3(\omega) \\ g_4(\omega) \\ g_5(\omega) \end{bmatrix}.$$

For convenience, this example shows a maximum N of order n equal to two. It is expressly noted that any other maximum order may be used as desired for the particular implementation (e.g., three, four, five, or more).

As demonstrated by the conjugates in expression (7), the spherical basis functions $Y_n^m$ are complex-valued functions. However, it is also possible to implement tasks X50, T630, and T410 to use a real-valued set of spherical basis functions instead.

In one example, the SHC are calculated (e.g., by task X50 or T630) as time-domain coefficients, or transformed into time-domain coefficients before transmission (e.g., by task T640). In such case, task T410 may be implemented to transform the time-domain coefficients into frequency-domain coefficients $A_n^m(\omega)$ before rendering.

Traditional methods of SHC-based coding (e.g., higher-order Ambisonics or HOA) typically use a plane-wave approximation to model the sound field to be encoded. Such an approximation assumes that the sources which give rise to the sound field are sufficiently distant from the observation location that each incoming signal may be modeled as a planar wavefront arriving from the corresponding source direction. In this case, the sound field is modeled as a superposition of planar wavefronts.

Although such a plane-wave approximation may be less complex than a model of the sound field as a superposition of spherical wavefronts, it lacks information regarding the distance of each source from the observation location, and it may be expected that separability with respect to distance of the various sources in the sound field as modeled and/or synthesized will be poor. Accordingly, a coding approach that models the sound field as a superposition of spherical wavefronts may be used instead.

It is also possible to configure such channel encoding to exploit the enhanced separability of the various sources that is provided by a spherical-wavefront model. For example, it may be desirable for a portion of a bitstream or file as described herein that carries the metadata to also include a flag or other indicator whose state indicates whether the spherical harmonic coefficients are of a planar-wavefront-model type or a spherical-wavefront model type. Such a portion may include other indicators (e.g., a near-field compensation (NFC) flag) and or text values as well.

Figure 3B:
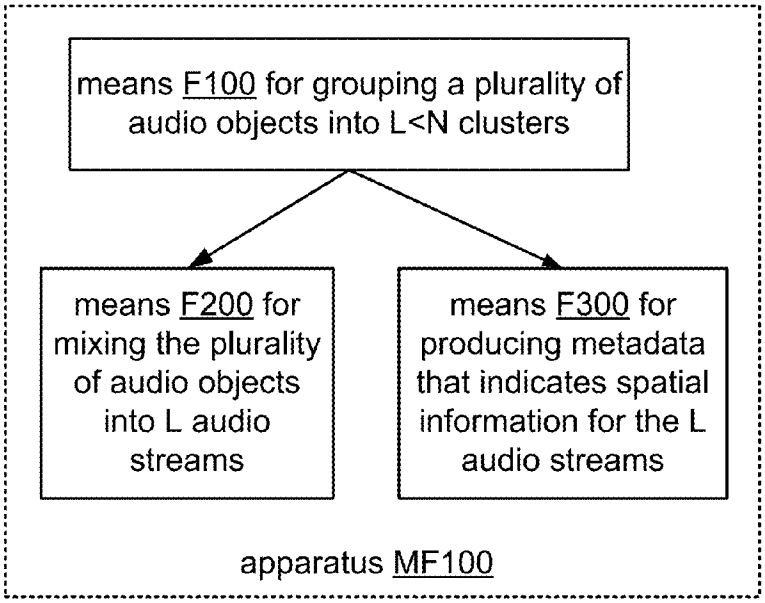
FIG. 3B shows a block diagram for an apparatus MF100 according to a general configuration.

FIG. 3B shows a block diagram for an apparatus MF100 according to a general configuration. Apparatus MF100 includes means F100 for grouping, based on spatial information for each of N audio objects, a plurality of audio objects that includes the N audio objects into L clusters, where L is less than N (e.g., as described herein with reference to task T100). Apparatus MF100 also includes means F200 for mixing the plurality of audio objects into L audio streams (e.g., as described herein with reference to task T200). Apparatus MF100 also includes means F300 for producing metadata, based on the spatial information and the grouping indicated by means F100, that indicates spatial information for each of the L audio streams (e.g., as described herein with reference to task T300).

Figure 3C:
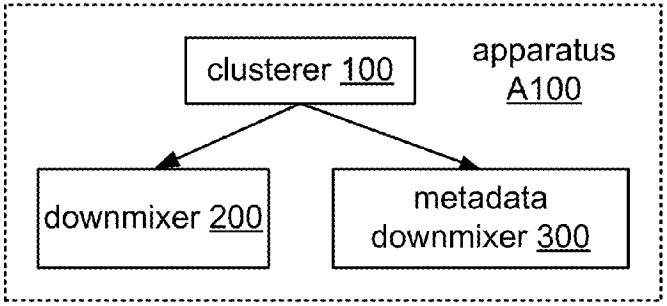
FIG. 3C shows a block diagram for an apparatus A100 according to a general configuration.

FIG. 3C shows a block diagram for an apparatus A100 according to a general configuration. Apparatus A100 includes a clusterer 100 configured to group, based on spatial information for each of N audio objects, a plurality of audio objects that includes the N audio objects into L clusters, where L is less than N (e.g., as described herein with reference to task T100). Apparatus A100 also includes a downmixer 200 configured to mix the plurality of audio objects into L audio streams (e.g., as described herein with reference to task T200). Apparatus A100 also includes a metadata downmixer 300 configured to produce metadata, based on the spatial information and the grouping indicated by clusterer 100, that indicates spatial information for each of the L audio streams (e.g., as described herein with reference to task T300).

Figure 6B:
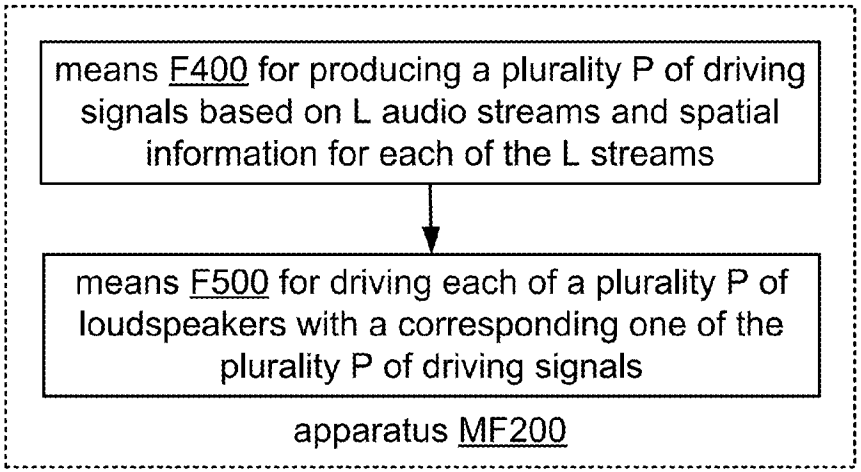
FIG. 6B shows a block diagram of an apparatus MF200 for audio signal processing according to a general configuration.

FIG. 6B shows a block diagram of an apparatus MF200 for audio signal processing according to a general configuration. Apparatus MF200 includes means F400 for producing a plurality P of driving signals based on L audio streams and spatial information for each of the L streams (e.g., as described herein with reference to task T400). Apparatus MF200 also includes means F500 for driving each of a plurality P of loudspeakers with a corresponding one of the plurality P of driving signals (e.g., as described herein with reference to task T500).

Figure 6C:
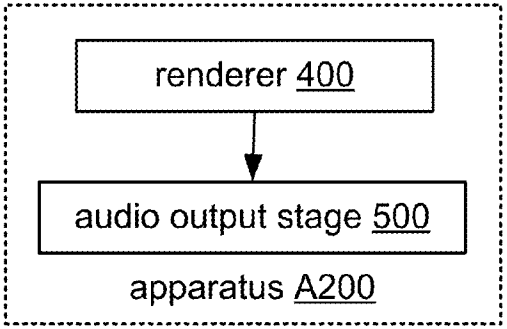
FIG. 6C shows a block diagram of an apparatus A200 for audio signal processing according to a general configuration.

FIG. 6C shows a block diagram of an apparatus A200 for audio signal processing according to a general configuration. Apparatus A200 includes a renderer 400 configured to produce a plurality P of driving signals based on L audio streams and spatial information for each of the L streams (e.g., as described herein with reference to task T400). Apparatus A200 also includes an audio output stage 500 configured to drive each of a plurality P of loudspeakers with a corresponding one of the plurality P of driving signals (e.g., as described herein with reference to task T500).

FIG. 13B shows a block diagram of an apparatus MF300 for audio signal processing according to a general configuration. Apparatus MF300 includes means F100, means F200, and means F300 as described herein. Apparatus MF300 also includes means F600 for encoding the L audio streams and corresponding metadata into L sets of SH coefficients (e.g., as described herein with reference to task T600).

Figure 13C:
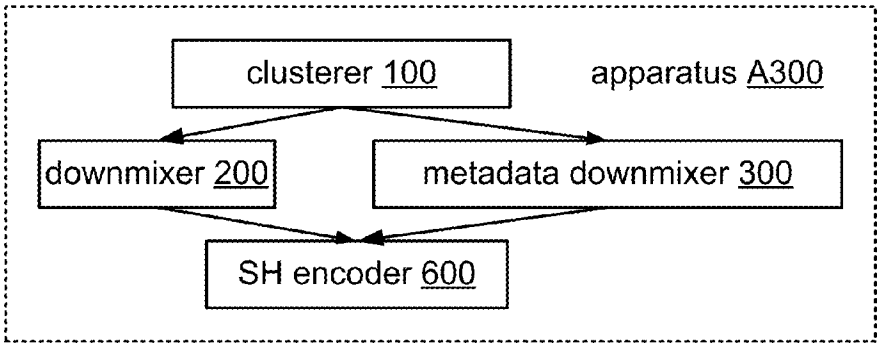
FIG. 13C shows a block diagram of an apparatus A300 according to a general configuration.

FIG. 13C shows a block diagram of an apparatus A300 for audio signal processing according to a general configuration. Apparatus A300 includes clusterer 100, downmixer 200, and metadata downmixer 300 as described herein. Apparatus MF300 also includes an SH encoder 600 configured to encode the L audio streams and corresponding metadata into L sets of SH coefficients (e.g., as described herein with reference to task T600).

Figure 15B:
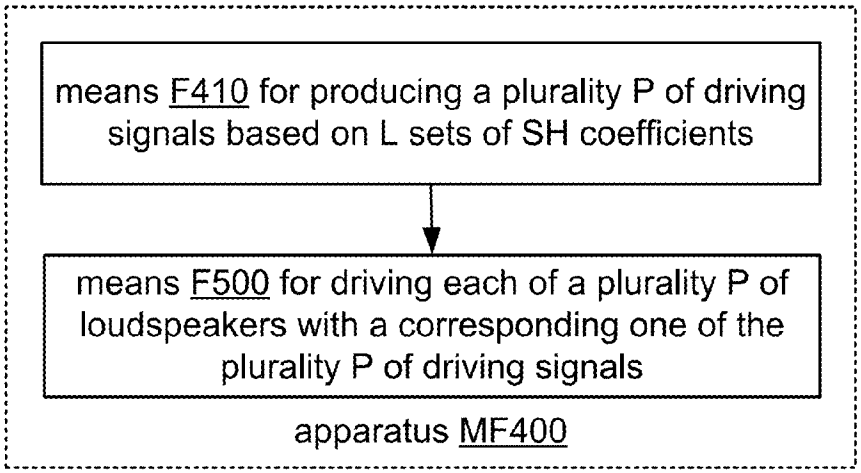
FIG. 15B shows a block diagram of an apparatus MF400 according to a general configuration.

FIG. 15B shows a block diagram of an apparatus MF400 for audio signal processing according to a general configuration. Apparatus MF400 includes means F410 for producing a plurality P of driving signals based on L sets of SH coefficients (e.g., as described herein with reference to task T410). Apparatus MF400 also includes an instance of means F500 as described herein.

Figure 15C:
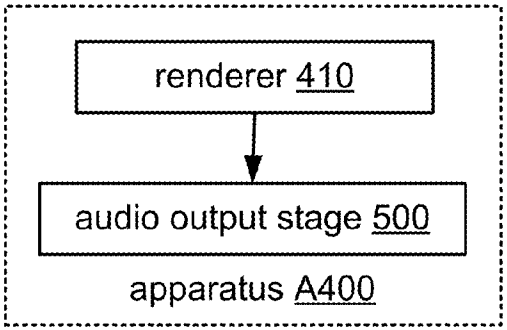
FIG. 15C shows a block diagram of an apparatus A400 according to a general configuration.

FIG. 15C shows a block diagram of an apparatus A400 for audio signal processing according to a general configuration. Apparatus A400 includes a renderer 410 configured to produce a plurality P of driving signals based on L sets of SH coefficients (e.g., as described herein with reference to task T410). Apparatus A400 also includes an instance of audio output stage 500 as described herein.

Figure 17B:
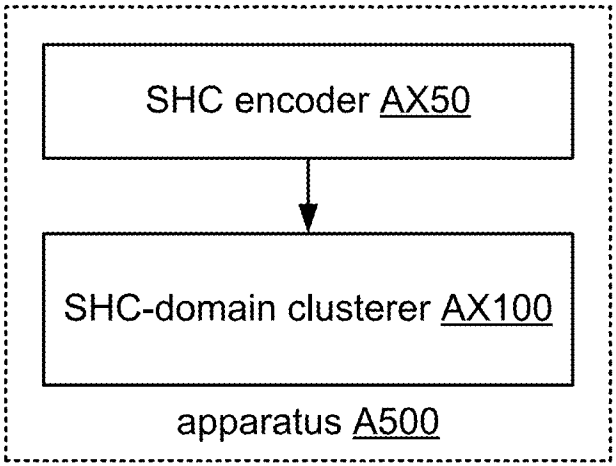
FIG. 17B shows a block diagram of an apparatus A500 according to a general configuration.
Figure 17A:
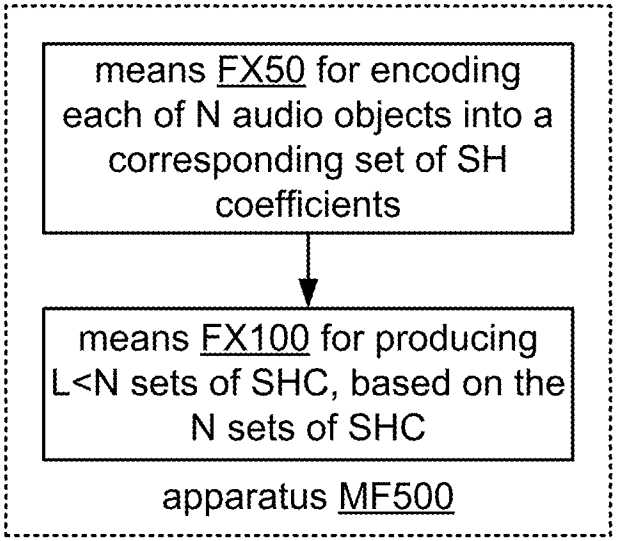
FIG. 17A shows a block diagram of an apparatus MF500 according to a general configuration.

FIG. 17A shows a block diagram of an apparatus MF500 for audio signal processing according to a general configuration. Apparatus MF500 includes means FX50 for encoding each of N audio objects into a corresponding set of SH coefficients (e.g., as described herein with reference to task X50). Apparatus MF500 also includes means FX100 for producing L sets of SHC, based on the N sets of SHC (e.g., as described herein with reference to task X100).

FIG. 17B shows a block diagram of an apparatus A500 for audio signal processing according to a general configuration. Apparatus A500 includes an SHC encoder AX50 configured to encode each of N audio objects into a corresponding set of SH coefficients (e.g., as described herein with reference to task X50). Apparatus A500 also includes an SHC-domain clusterer AX100 configured to produce L sets of SHC, based on the N sets of SHC (e.g., as described herein with reference to task X100). In one example, clusterer AX100 includes a vector adder configured to add the component SHC coefficient vectors for a cluster to produce a single SHC coefficient vector for the cluster.

The methods and apparatus disclosed herein may be applied generally in any transceiving and/or audio sensing application, including mobile or otherwise portable instances of such applications and/or sensing of signal components from far-field sources. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein (e.g., smartphones, tablet computers) may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

An apparatus as disclosed herein (e.g., any of apparatus A100, A200, A300, A400, A500, MF100, MF200, MF300, MF400, and MF500) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of the elements of the apparatus may be implemented within the same array or arrays. Such an array or arrays may be implemented within one or more chips (for example, within a chipset including two or more chips).

One or more elements of the various implementations of the apparatus disclosed herein (e.g., any of apparatus A100, A200, A300, A400, A500, MF100, MF200, MF300, MF400, and MF500) may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a downmixing procedure as described herein, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., any of methods M100, M200, M300, M400, M500, and M510) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein (e.g., apparatus A100 or MF100) may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

The invention claimed is:

1. A method of audio signal processing performed by an audio signal processing device, said method comprising:

receiving, via an audio interface of the audio signal processing device, N sets of spherical harmonic coefficients;

determining, by one or more processors of the audio signal processing device, a direction in space associated with each of the N sets of spherical harmonic coefficients, wherein each of the N sets of spherical harmonic coefficients represents an audio signal;

grouping, by the one or more processors, the N sets of spherical harmonic coefficients into L clusters based on said associated directions in space and an indication of a user's head orientation received from a renderer;

mixing, by the one or more processors and according to said grouping, the plurality of sets of spherical harmonic coefficients into L sets of spherical harmonic coefficients, wherein L is less than N, and wherein at least two sets among the L sets of spherical harmonic coefficients have different numbers of spherical harmonic coefficients; and producing, based on the determined directions in space and the grouping, metadata that indicates spatial information for each of the L audio streams.

2. The method according to claim 1, wherein each of said N sets of spherical harmonic coefficients is a set of coefficients of orthogonal basis functions.

3. The method according to claim 1, wherein said mixing comprises, for each of at least one among the L clusters, calculating a sum of at least two sets among said plurality of sets of spherical harmonic coefficients.

4. The method according to claim 1, wherein said mixing comprises calculating each among the L sets of spherical harmonic coefficients as a sum of the corresponding ones among the N sets of spherical harmonic coefficients.

5. The method according to claim 1, wherein at least two among the N sets of spherical harmonic coefficients have different numbers of spherical harmonic coefficients.

6. The method according to claim 1, wherein, for at least one among the L sets of spherical harmonic coefficients, a total number of spherical harmonic coefficients in the set is based on a bit rate indication.

7. The method according to claim 1, wherein, for at least one among the L sets of spherical harmonic coefficients, a total number of spherical harmonic coefficients in the set is based on information received from at least one among a transmission channel, and a decoder.

8. The method according to claim 1, wherein, for at least one among the L sets of spherical harmonic coefficients, a total number of spherical harmonic coefficients in the set is based on a total number of spherical harmonic coefficients in at least one among the corresponding ones among the N sets of spherical harmonic coefficients.

9. The method according to claim 1, wherein each of said N sets of spherical harmonic coefficients describes an audio object.

10. A non-transitory computer-readable data storage medium having instructions stored thereon that, when executed, cause one or more processors to:

interface with an audio interface to receive N sets of spherical harmonic coefficients;

determine a direction in space associated with each of the N sets of spherical harmonic coefficients, each of the N sets of spherical harmonic coefficients represents an audio signal;

group the N sets of spherical harmonic coefficients into L clusters based on said associated directions in space and an indication of a user's head orientation received from a renderer;

according to said grouping, mix the plurality of sets of spherical harmonic coefficients into L sets of spherical harmonic coefficients, wherein L is and less than N, and wherein at least two sets among the L sets of spherical harmonic coefficients have different numbers of spherical harmonic coefficients; and produce, based on the determined directions in space and the grouping, metadata that indicates spatial information for each of the L audio streams.

11. An apparatus for audio signal processing, said apparatus comprising:

means for determining a direction in space associated with each of N sets of spherical harmonic coefficients, each of the N sets of spherical harmonic coefficients represents an audio signal, means for grouping the N sets of spherical harmonic coefficients into L clusters based on said associated directions in space and an indication of a user's head orientation received from a renderer;

means for mixing the plurality of sets of spherical harmonic coefficients into L sets of spherical harmonic coefficients, according to said grouping, wherein L is less than N, and wherein at least two sets among the L sets of spherical harmonic coefficients have different numbers of spherical harmonic coefficients; and means for producing, based on the determined directions in space and the grouping, metadata that indicates spatial information for each of the L audio streams.

12. An apparatus for audio signal processing, said apparatus comprising:

an audio interface configured to receive N sets of spherical harmonic coefficients;

a clusterer configured to determine a direction in space associated with each of the N sets of spherical harmonic coefficients and group the N sets of spherical harmonic coefficients into L clusters based on said associated directions in space and an indication of a user's head orientation received from a renderer, each of the N sets of spherical harmonic coefficients represents an audio signal;

a downmixer configured to mix the plurality of sets of spherical harmonic coefficients into L sets of spherical harmonic coefficients, according to said grouping, wherein L is less than N, and wherein at least two sets among the L sets of spherical harmonic coefficients have different numbers of spherical harmonic coefficients; and a metadata downmixer configured to produce, based on the determined directions in space and the grouping, metadata that indicates spatial information for each of the L audio streams.

13. The apparatus according to claim 12, wherein each of said N sets of spherical harmonic coefficients is a set of spherical harmonic coefficients of orthogonal basis functions.

14. The apparatus according to claim 12, wherein said downmixer is configured to calculate each among the L sets of spherical harmonic coefficients as a sum of the corresponding ones among the N sets of spherical harmonic coefficients.

15. The apparatus according to claim 12, wherein at least two among the N sets of spherical harmonic coefficients have different numbers of spherical harmonic coefficients.

16. The method of claim 1, further comprising:

receiving, from a device, the indication of the local rendering environment.

17. The method of claim 1, further comprising:

receiving, from a device comprising a loudspeaker array, the indication of the local rendering environment.

18. The apparatus of claim 12, further comprising:

one or more microphones to record respective PCM streams for N audio objects, wherein each of the one or more microphones is associated with a spatial position, wherein the apparatus is configured to generate each of the N audio objects to encapsulate the corresponding PCM stream and the spatial information based on the spatial positions of the one or more microphones.

19. The apparatus of claim 12, wherein the clusterer is further configured to receive, from a device, the indication of the local rendering environment.

20. The apparatus of claim 12, wherein the clusterer is further configured to receive, from a device comprising a loudspeaker array, the indication of the local rendering environment.

* * * * *